US009801505B2

(12) United States Patent
Buckalter et al.

(10) Patent No.: US 9,801,505 B2
(45) Date of Patent: Oct. 31, 2017

(54) AUTOMATIC FLUID DISPENSER

(71) Applicant: Toaster Labs, Inc., Seattle, WA (US)

(72) Inventors: Amy Carol Buckalter, Seattle, WA (US); Jonathan B. Hadley, Renton, WA (US); Alexander M. Diener, Seattle, WA (US); Kristin M. Will, Seattle, WA (US); Lilac Muller, Woodinville, WA (US); Jeanine E. Spence, Kenmore, WA (US)

(73) Assignee: Toaster Labs, Inc., Seattle, WA (US)

( * ) Notice: Subject to any disclaimer, the term of this patent is extended or adjusted under 35 U.S.C. 154(b) by 0 days.

(21) Appl. No.: 14/137,130

(22) Filed: Dec. 20, 2013

(65) Prior Publication Data

US 2015/0173567 A1 Jun. 25, 2015

(51) Int. Cl.

| | |
|---|---|
| ***A47K 5/12*** | (2006.01) |
| ***A47K 5/122*** | (2006.01) |
| ***B05B 9/00*** | (2006.01) |
| ***B05B 9/08*** | (2006.01) |
| ***B05B 12/12*** | (2006.01) |

(52) U.S. Cl.

CPC ..... *A47K 5/1217* (2013.01); *A47K 5/122* (2013.01); *A47K 5/1211* (2013.01); *B05B 9/002* (2013.01); *B05B 9/0838* (2013.01); *B05B 12/122* (2013.01)

(58) Field of Classification Search

CPC .... A47K 5/1217; A47K 5/1211; A47K 5/122; B05B 9/002; B05B 9/0838; B05B 12/122

USPC ..... 222/52, 95, 103, 105, 113, 146.2, 146.5, 222/180, 325–327, 386, 213, 214

See application file for complete search history.

(56) References Cited

U.S. PATENT DOCUMENTS

| | | | |
|---|---|---|---|
| 1,537,552 | A | 2/1923 | Rotunno |
| 3,813,012 | A | 5/1974 | Laird |

(Continued)

FOREIGN PATENT DOCUMENTS

| | | | |
|---|---|---|---|
| DE | 1654872 | A1 | 4/1971 |
| DE | 10122337 | A1 | 12/2002 |

(Continued)

OTHER PUBLICATIONS

International Search Report; pp. 19; dated Nov. 22, 2016.
International Search Report; pp. 5; dated Nov. 22, 2016.
International Search Report; dated Oct. 2, 2016; 4 Pages.

*Primary Examiner* — Nicholas J Weiss
(74) *Attorney, Agent, or Firm* — Lowe Graham Jones PLLC

(57) ABSTRACT

A motion-activated dispenser includes a housing having a base and top defining a gap sized to receive a human hand. The top portion defining cavity sized to receive a fluid reservoir and an opening extending directly through a lower surface of the top portion to the cavity, a neck of the fluid reservoir extending through the opening. A pressing member is positioned within the cavity and an actuator is coupled to the pressing member and configured to urge the pressing member toward and away from the opening. The pressing member may include, for example, a sliding member positioned opposite a stop face; a roller moved by the actuator toward the opening; a plunger positioned above the opening and driven by an actuator toward the opening; or a pair of rods spanning the cavity and urged by the actuator through the cavity, the rods pressing against sides of the reservoir.

19 Claims, 18 Drawing Sheets

(56) References Cited

U.S. PATENT DOCUMENTS 3,880,331 A 4/1975 Perkins
4,258,865 A 3/1981 Vahl et al.
4,426,024 A 1/1984 Hogan et al.
4,645,094 A * 2/1987 Acklin ..... A47K 5/1217 222/103
4,809,878 A 3/1989 Rainey
4,875,604 A 10/1989 Czech
4,921,131 A * 5/1990 Binderbauer ..... A47K 5/12 220/4.25
4,946,072 A * 8/1990 Albert ..... A47K 5/1217 222/105
4,967,937 A 11/1990 von Schuckmann
5,015,233 A 5/1991 McGough et al.
5,024,656 A 6/1991 Gasaway et al.
5,096,092 A 3/1992 Devine
5,100,025 A 3/1992 McGraw
5,104,004 A 4/1992 von Schuckmann
5,150,820 A 9/1992 McGill
5,240,144 A 8/1993 Feldman
5,452,824 A 9/1995 Danek et al.
5,636,922 A 6/1997 Clark
5,700,991 A 12/1997 Osbern
5,788,124 A 8/1998 Bougamont et al.
5,810,201 A 9/1998 Besse et al.
5,836,482 A 11/1998 Ophardt et al.
5,918,767 A 7/1999 McGill
6,013,270 A 1/2000 Hargraves et al.
6,131,766 A * 10/2000 King ..... B67D 7/0227 222/1
6,209,751 B1 4/2001 Goodin et al.
6,209,752 B1 4/2001 Mitchell et al.
6,216,911 B1 4/2001 Kreitemier et al.
6,279,777 B1 8/2001 Goodin et al.
6,302,304 B1 10/2001 Spencer
6,311,868 B1 11/2001 Krietemeier et al.
6,454,127 B1 9/2002 Suomela et al.
6,460,481 B1 * 10/2002 Young ..... A23G 3/28 118/14
6,467,651 B1 10/2002 Muderlak et al.
6,607,103 B2 8/2003 Gerenraich et al.
6,820,765 B2 11/2004 Pahl
6,866,163 B2 3/2005 McGill
6,978,912 B2 12/2005 Taylor et al.
7,033,004 B2 4/2006 Ghisalberti et al.
7,086,568 B1 * 8/2006 Cheek ..... B65D 35/565 222/103
7,163,130 B2 1/2007 Lafond
7,337,920 B2 3/2008 Duck et al.
7,477,148 B2 * 1/2009 Lynn ..... A47K 5/1202 340/540
7,527,178 B2 5/2009 Lewis
7,687,744 B2 3/2010 Walter et al.
8,056,764 B2 11/2011 Paasch et al.
8,061,918 B2 11/2011 Skalitzky et al.
8,087,543 B2 1/2012 Yang et al.
8,096,445 B2 1/2012 Yang et al.
8,104,982 B2 1/2012 Duru
8,109,411 B2 2/2012 Yang et al.
8,240,933 B2 8/2012 Skalitzky et al.
8,261,941 B2 * 9/2012 Woo ..... A47K 5/1217 222/113
8,336,738 B2 12/2012 Bouix et al.
8,353,427 B2 * 1/2013 Landauer ..... A47K 5/12 222/108
8,453,877 B2 6/2013 Ionidis
8,757,454 B2 6/2014 Dong et al.
8,783,511 B2 7/2014 Snodgrass
8,785,819 B2 7/2014 Madigan et al.
8,792,781 B1 7/2014 Randall et al.
8,882,378 B2 11/2014 Bylsma et al.
8,921,746 B2 12/2014 Baarman et al.
8,998,036 B2 4/2015 Zhou et al.
9,237,831 B1 1/2016 Luu et al.
9,271,613 B2 3/2016 Rosko et al.
2002/0108965 A1 8/2002 Hill et al.
2004/0129722 A1 7/2004 Pahl
2004/0226962 A1 11/2004 Mazursky et al.
2006/0054641 A1 3/2006 Evers
2006/0113326 A1 6/2006 Taylor et al.
2007/0000941 A1 1/2007 Hadden et al.
2008/0011784 A1 1/2008 Schneider et al.
2008/0078780 A1 4/2008 Sanger et al.
2008/0142551 A1 6/2008 Strobel-Schmidt
2009/0038685 A1 2/2009 Hill et al.
2009/0134139 A1 5/2009 Quartararo
2009/0140004 A1 * 6/2009 Scorgie ..... A47K 5/1217 222/52
2011/0303695 A1 12/2011 Fern
2012/0085780 A1 4/2012 Landauer
2012/0085784 A1 4/2012 Bakris
2012/0111885 A1 5/2012 Binderbauer et al.
2012/0168459 A1 7/2012 D'Onofrio
2012/0305605 A1 12/2012 Vassaux et al.
2013/0020350 A1 1/2013 Gardos et al.
2013/0264328 A1 10/2013 Ulvr
2013/0264355 A1 10/2013 Jodoin
2014/0138402 A1 5/2014 Warren et al.
2014/0197198 A1 7/2014 Paetow et al.
2014/0219701 A1 8/2014 Eberlein
2014/0263440 A1 * 9/2014 Burns ..... B05C 17/00583 222/95
2014/0353335 A1 12/2014 Van Diepen
2015/0078799 A1 3/2015 Baarman et al.
2015/0083754 A1 3/2015 Proper et al.
2015/0245421 A1 8/2015 Heczko
2015/0273513 A1 10/2015 Buckalter et al.

FOREIGN PATENT DOCUMENTS

DE 202012000728 U1 4/2012
EP 0333093 A1 9/1989
EP 0914055 B1 1/2000
EP 1076810 A1 2/2001
EP 1240480 A1 9/2002
EP 1345840 A2 9/2003
EP 1991095 A2 11/2008
EP 2033555 A1 3/2009
EP 2108106 A1 10/2009
EP 2074906 B1 4/2010
EP 2225988 9/2010
EP 2274211 A1 1/2011
EP 2364623 A2 9/2011
EP 2579831 A2 4/2013
EP 2865307 A1 4/2015
EP 2637539 B1 5/2015
EP 2640221 A4 5/2015
EP 2451330 B1 7/2015
FR 2873048 A1 7/2004
JP 2001109943 A 4/2001
WO 0214211 A1 2/2002
WO 2005002283 A1 1/2005
WO 2007120791 A2 10/2007
WO 2007120791 A3 10/2007

* cited by examiner

AUTOMATIC FLUID DISPENSER

FIELD OF THE INVENTION

This application relates to dispensers for viscous fluid and, more particularly, to motion-activated dispensers.

BACKGROUND OF THE INVENTION

Soap dispensers that are motion activated are well known. Such dispensers advantageously reduce the spread of germs and disease by not requiring any contact with the dispensers. Automated soap dispensers typically have large amounts of fluid that flows freely. The mechanisms of such dispensers retain a residual amount of soap, which is acceptable given the large reservoir size. Soap is left in the container. Soap also typically contacts the dispensing mechanism outside the container.

Motion activated dispensing could be advantageously used for other fluids such as personal lubricants or other substances dispensed in medical applications. In particular, the lack of contamination may be ideal. However, the dispensing of other fluids may not effectively be performed using existing soap dispensing mechanisms inasmuch as residual fluid left in the dispenser may be messy, non-hygienic, or result in unacceptable waste.

The systems and methods disclosed herein provide an improved dispensing mechanism that can be used for personal lubricants or other viscous fluids.

SUMMARY OF THE INVENTION

In one aspect of the invention, a dispenser includes a housing having a base configured to stably rest on a support surface. The housing includes a top portion positioned above the base such that a gap between the base and top portion is sized to receive a human hand. The top portion defines a cavity sized to receive a fluid reservoir and an opening extending directly through a lower surface of the top portion to the cavity. A pressing member is positioned within the cavity and an actuator is coupled to the pressing member and configured to urge the pressing member toward and away from the opening. A fluid reservoir may be positioned within the cavity, the fluid reservoir including a neck having a pressure actuated opening at a distal end thereof, the neck extending through the opening. In some embodiments, no portion of the dispenser, other than the base, is positioned in a flow path vertically beneath the pressure actuated opening.

In another aspect, the dispenser includes a controller mounted within the housing and operably coupled to the actuator, the controller configured to selectively activate the actuator. The dispenser may include a proximity sensor mounted in the housing and configured to detect movement within the gap. Alternatively, the sensor may be a motion detector or other sensor. In the preferred embodiment, the proximity sensor is operably coupled to the controller and the controller configured to activate the actuator in response to an output of the proximity sensor. In some embodiments, the proximity sensor is mounted within the top portion and the controller is mounted within the base. The dispenser may further include a light emitting device mounted within a portion of the housing, preferably within the top portion. The top portion in such embodiment includes a downward facing translucent panel positioned below the light emitting device. The controller may be configured to activate the actuator to move between positions of a plurality of discrete positions including a start position and an end position in response to detecting of movement in the gap by the proximity sensor. The controller may also be configured to activate the actuator to move to the start position in response to detecting positioning of the actuator in the end position. The dispenser may additionally include a temperature-control element in thermal contact with the cavity or otherwise placed to heat the fluid reservoir. The temperature-control element is preferably a heating element, such as a resistance heater.

In another aspect, the actuator is configured to urge the pressing member in a first direction and the top portion includes a stop face arranged substantially transverse to the first direction (i.e., substantially normal to the first direction) and offset to a first side of the opening. The pressing member may include a pressing face extending upward from the opening and having a normal substantially parallel to the first direction. The pressing member may be positioned on a second side of the opening opposite the first side. The actuator is configured to urge the pressing member perpendicular to the first direction. In some embodiments, the top portion defines rails extending perpendicular to the first direction, the pressing member being configured to slidingly receive the rails. The fluid reservoir may be collapsible and positioned within the cavity having a first surface in contact with the stop face and a second surface in contact with the pressing face, the neck abutting the first surface, the body of the collapsible reservoir may have a substantially constant cross section along substantially an entire extent of the body between the first and second surfaces.

In another aspect, the pressing member includes a roller rotatably coupled to the actuator and defining an axis of rotation. The actuator is configured to move the roller in a first direction perpendicular to the axis of rotation across the cavity toward and away from the opening. The pressing member may include an axle extending through the roller, the top portion defining guides engaging end portions of the axle. The actuator may be coupled to the end portions of the axis by means of a flexible but substantially inextensible line. Springs may be coupled to the end portions of the axle and configured to urge the roller to a starting position offset from the opening.

In another aspect, the opening extends in a first direction through the lower surface of the top portion and the pressing member is positionable at a starting position having the cavity positioned between the opening and the pressing member. The actuator is configured to urge the pressing member from the starting position toward the opening along the first direction. In some embodiments, the lower surface of the top portion defines an aperture and a lid is hingedly secured to the lower surface and is selectively positionable over the aperture, the opening being defined in the lid. In some embodiments, one or more members extend from the cavity to a position offset from the cavity, each member of the one or more members being pivotally mounted to the top portion and including a first arm extending over the pressing member having the pressing member positioned between the first arm and the opening; and a second arm engaging the actuator.

In another aspect first and second rods are each pivotally coupled at a first end to one side of the cavity and having a second end positioned on an opposite side of the cavity. The actuator engages the first and second rods and is configured to draw the first and second rods through the cavity toward the opening.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
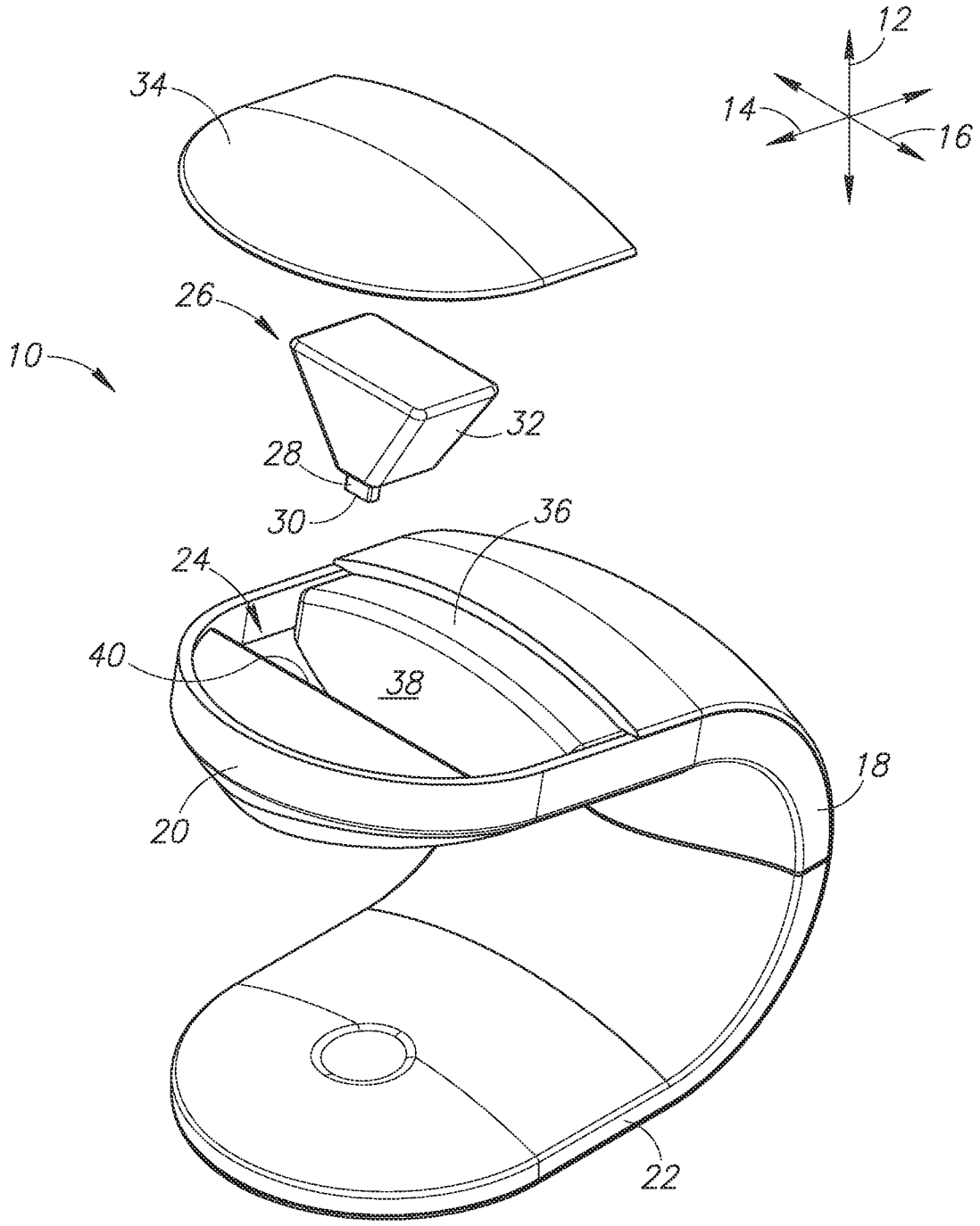
FIG. 1 is an isometric view of a first embodiment of a dispenser incorporating a compressing element in accordance with an embodiment of the invention.

Referring to FIG. 1, a dispenser 10 may be understood with respect to a vertical direction 12, a longitudinal direction 14 perpendicular to the vertical direction 12, and a lateral direction 16 perpendicular to the vertical and longitudinal directions 12, 14. The vertical direction 12 may be perpendicular to a planar surface on which the dispenser 10 rests. Likewise, the lateral and longitudinal directions 14, 16 may be parallel to the support surface.

The dispenser 10 may include a housing 18 that has a C-shape in the longitudinal-vertical plane. Accordingly, the housing 18 may include an upper portion 20 and a base 22 such that a vertical gap is defined between the upper portion 20 and the base 22. The upper portion 20 may define a cavity 24 for receiving a reservoir 26. The reservoir 26 may include a neck 28 defining an opening 30 and a body 32 coupled to the neck 28. The neck 28 may be smaller such that the body 32 can be inserted into an opening through which the body 32 cannot pass, or cannot pass through without deformation. The cavity 24 may be wider than the body 32 in the lateral direction 16 to facilitate removal of the reservoir 26. The opening 30 may be a pressure sensitive opening that is closed in the absence of pressure applied to the body 32, but will permit fluid to pass therethrough in response to an above-threshold pressure at the opening 30. For example, the opening 30 may be any of various "no-drip" systems used in many condiment dispensers known in the art.

The cavity 24 may be accessible by means of a lid 34 covering a portion of the upper portion 20. The lid 34 may secure to the upper portion 20 vertically above the upper portion 20, vertically below the upper portion 20 or to a lateral surface of the upper portion 20. The lid 34 may be completely removable and secure by means of a snap fit or some other means. The lid 34 may also be hingedly secured to the upper portion or slide laterally in and out of a closed position. For example, a slide out drawer defining a portion of the cavity 24 for receiving the reservoir 26 may slide in and out of a lateral surface of the upper portion 20.

A pressing member 36 is slidable into and out of the cavity 24 in order to compress the reservoir 26 and retract to enable insertion of a refill reservoir 26 after an extractable amount of fluid has been pressed out of an original reservoir 26. The pressing member 36 may define a pressing face 38 positioned opposite a stop face 40 defining a wall of the cavity 24.

Figure 2:
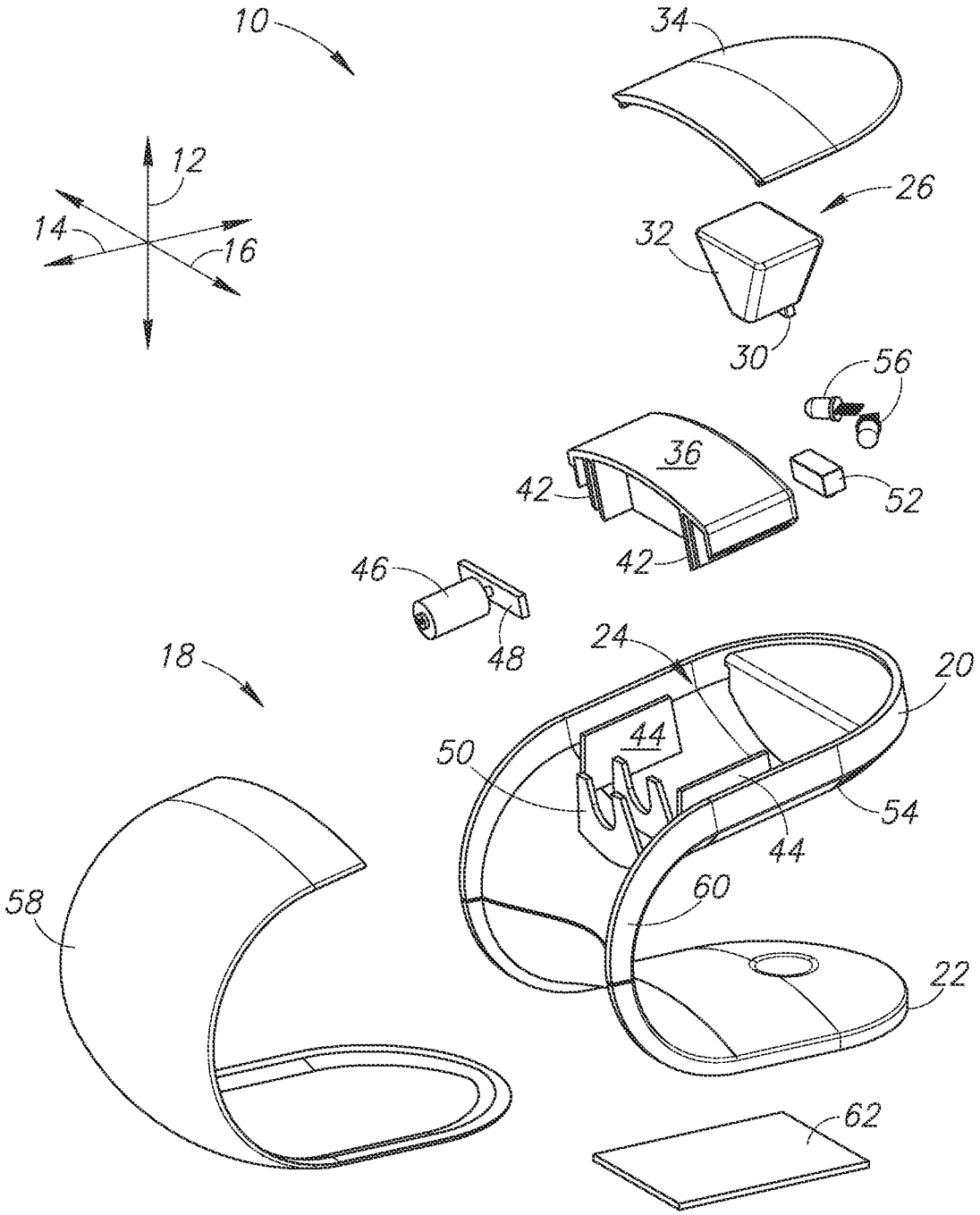
FIG. 2 is an exploded view of the dispenser of FIG. 1.

Referring to FIG. 2, the pressing member 36 may slidably mount to the housing 18. For example, the pressing member 36 may define one or more slots 42 that receive rails 44 secured to the upper portion 20. Alternatively, rails formed on the pressing member 36 may insert within slots defined by the upper portion 20. An actuator 46 may engage the pressing member 36 in order to move the pressing member 36 toward the reservoir 26 in order to force fluid therefrom. The actuator 46 may be any linear actuator, such as a motor driven screw or worm gear, servo, rotating cam, or the like. In particular, the actuator 46 may advantageously maintain its state in the absence of applied power. The actuator 46 may secure within one or more actuator mounts 50 secured to the upper portion 20 or some other portion of the housing 18, including the base 22. In the illustrated embodiment, the actuator 46 engages the pressing member 36 by means of a spreader 48 that distributes the force over a greater area of the pressing member 36.

The dispenser 10 may include a proximity sensor 52 that is configured to sense the presence of a human hand within the gap between the upper and lower portions 20, 22. The mode in which the proximity sensor 52 identifies the presence of a human hand may include various means such as by detecting reflected light, interruption of light incident on the proximity sensor 52, detecting a thermal signature or temperature change, change in inductance or capacitance, or any other modality for detecting movement, proximity, or presence of hand. The proximity sensor 52 may protrude below a lower surface 54 of the upper portion 20 or be exposed through the lower surface 54 to light, air, or thermal energy in the gap between the upper and lower portions 20, 22. Other sensors than proximity sensors may be employed, such as voice-activated sensors. Furthermore, multiple sensors may be employed in the same or various parts of the device.

In some embodiments, one or more light-emitting elements 56 may be mounted in the upper portion 20 and emit light into the gap between the upper and lower portions 20, 22. For example, the lower surface 54 or a portion thereof may be translucent or perforated to allow the light from the light-emitting elements to reach the gap. The light-emitting elements 56 may be light emitting diodes (LED), incandescent bulbs, or other light emitting structure. Alternatively, lighting elements may provide light emitting from the bottom or side.

Various structures or shapes may form the housing 18. In the illustrated embodiment, the housing 18 includes a curved outer portion 58 and a curved inner portion 60 that when engaged define a curved or C-shaped cavity for receiving the components of the dispenser 10. The ends of the curved portions 58, 60 may be planar, or include planar surfaces. In particular, the outer curved portion 58 may include a lower end with a planar lower surface for resting on a flat surface, or three or more points that lie in a common plane for resting on a flat surface.

A controller 62 may mount within the housing 18, such as within the base 22. The controller 62 may be operably coupled to some or all of the actuator 46, proximity sensor 52, and light-emitting elements 56. The controller 62 may be coupled to these elements by means of wires. The controller 62 may also be coupled to a power source (not shown) such as a battery or power adapter. The controller 62 may be embodied as a printed circuit board having electronic components mounted thereon that are effective to perform the functions attributed to the controller 62. The controller 62 may include a processor, memory, or other computing capabilities to perform the functions attributed thereto.

Figure 3:
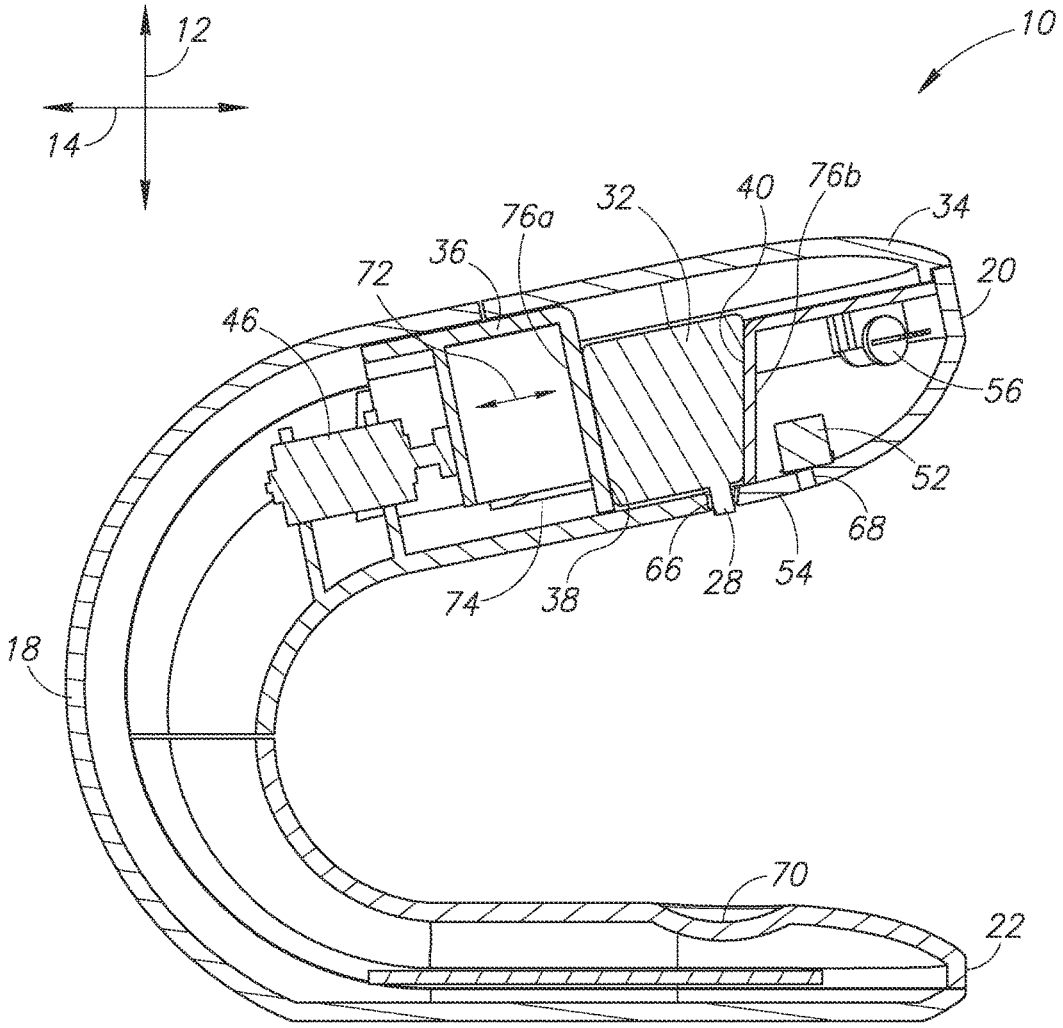
FIG. 3 is a side cross-sectional view of the dispenser of FIG. 1.
Figure 4:
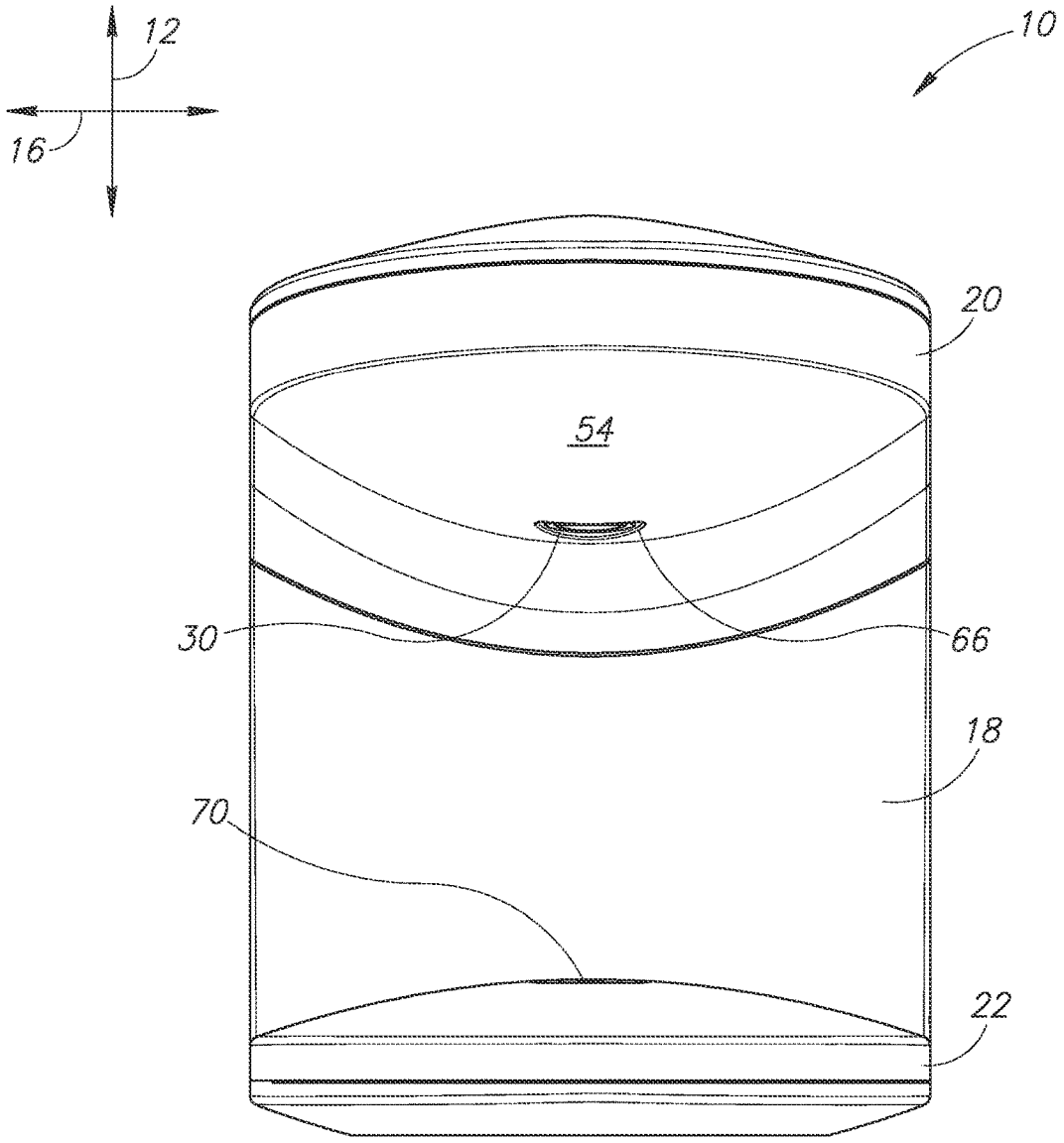
FIG. 4 is a front elevation view of the dispenser of FIG. 1.

Referring to FIGS. 3 and 4, the lower surface 54 of the upper portion 20 may define an opening 66 for receiving the neck 28 of the reservoir 26. As shown, the opening 30 is free to dispense fluid without the fluid being incident on any portion of the dispenser, other than the base 22, if the fluid is not incident on a user's hand. As is also apparent, the opening 30 and the neck 28 are disposed closer to the stop face 40 than to the pressing face 38. In this manner, as the body 32 of the reservoir 26 is collapsed, the neck 38 inserted within the opening 30 does not interfere with advancing of the pressing face 38. The neck 28 may be located as close as possible to the surface of the body 32 engaging the stop face 40. For example, a gap between the stop face 40 and the pressing face 38 above the opening 66, e.g. measured parallel to the surface of the housing supporting the reservoir 26, may be X and the distance between the stop face 40 and the neck 28 and the side of the neck closest the stop face may be less than 10% X, preferably less than 5% X.

The lower surface 54 of the upper portion 20 may additionally define an opening 68 for receiving a portion of the proximity sensor 52 or for allowing light, vibrations, thermal energy, and the like to be incident on the proximity sensor 52. The lower surface 54 may additionally include an opening for allowing light from the light-emitting devices 56 to radiate the gap. Alternatively, the lower surface 54 may be translucent or transparent or include translucent or transparent portions to allow light to pass through the lower surface 54. In some embodiments, a marker 70, such as a depression, painted mark, or other visual indicator may be defined in an upper surface of the base 22 positioned vertically below the opening 66 to indicate where the dispenser 10 will dispense fluid.

The pressing member 36 may slide back and forth in an actuator direction 72 that is generally parallel to the longitudinal direction, e.g. within 20 degrees. The pressing face 38 may be substantially perpendicular to the actuator direction 72, e.g. the normal of the pressing face 38 may be within +/−5, preferably within +/−1, degree of parallel to the actuator direction 72. The stop face 40 may also be substantially perpendicular to the actuator direction (i.e. have a nearly parallel normal). However, in the illustrated embodiment, the stop face 40 is slanted to facilitate insertion of the reservoir 26. For example, the stop face may have a normal that points upward from the actuator direction 72 by between 2 and 10 degrees, or some other non-zero angle.

In some embodiments, the reservoir 26 may be directly or indirectly heated by a heating element 74 that may be operably coupled to the controller 62 or directly to a power source and may include a thermal sensor enabling thermostatic control thereof. In the illustrated embodiment, the heating element 74 is coupled to the pressing member 36, such as to the illustrated lower surface of the pressing member perpendicular to the pressing face 38. Other possible locations include the illustrated location **76*a* immediately opposite the pressing face 38 or location 76*b* immediately opposite the stop face 40. In some embodiments, it may be sufficient to simply heat the air around the reservoir 26 such that thermal contact with the reservoir 26 or structure facing the reservoir 26 is not required. Accordingly, the heating element 74 may be placed at any convenient location within the upper portion 20 or some other part of the housing 18**. Other temperature-control elements may alternatively be used to either heat or cool or maintain a temperature of the fluid.

The controller 62 may be configured to move the pressing member 36 from a starting position shown in FIG. 3 to an end position located closer to the stop face 40. The controller 62 may be configured to move the pressing member 36 between discrete positions between the start and end positions. For example, the controller 62 may be configured to cause the actuator 46 to move the pressing member 36 from one position to a next position responsive to a detecting of movement based on an output of the proximity sensor 52. Upon detecting the pressing member 36 reaching the end position, the controller 62 may be configured to cause the actuator 46 to move the pressing member 36 to the start position. Detecting reaching of the end position may be determined by counting a number of times the pressing member 36 has been advanced from the start position, e.g. upon advancing the pressing member N times, the controller 46 may be configured to return the pressing member to the start position. In one preferred embodiment, the user may adjust the amount of advancement of the pressing member 36 with the controller. In this way an individual user may have more or less fluid delivered to the hand upon placing the hand beneath the opening. A rotatable adjustment knob or other switch (e.g., up & down arrow buttons) may be provided for such purpose.

Figure 5:
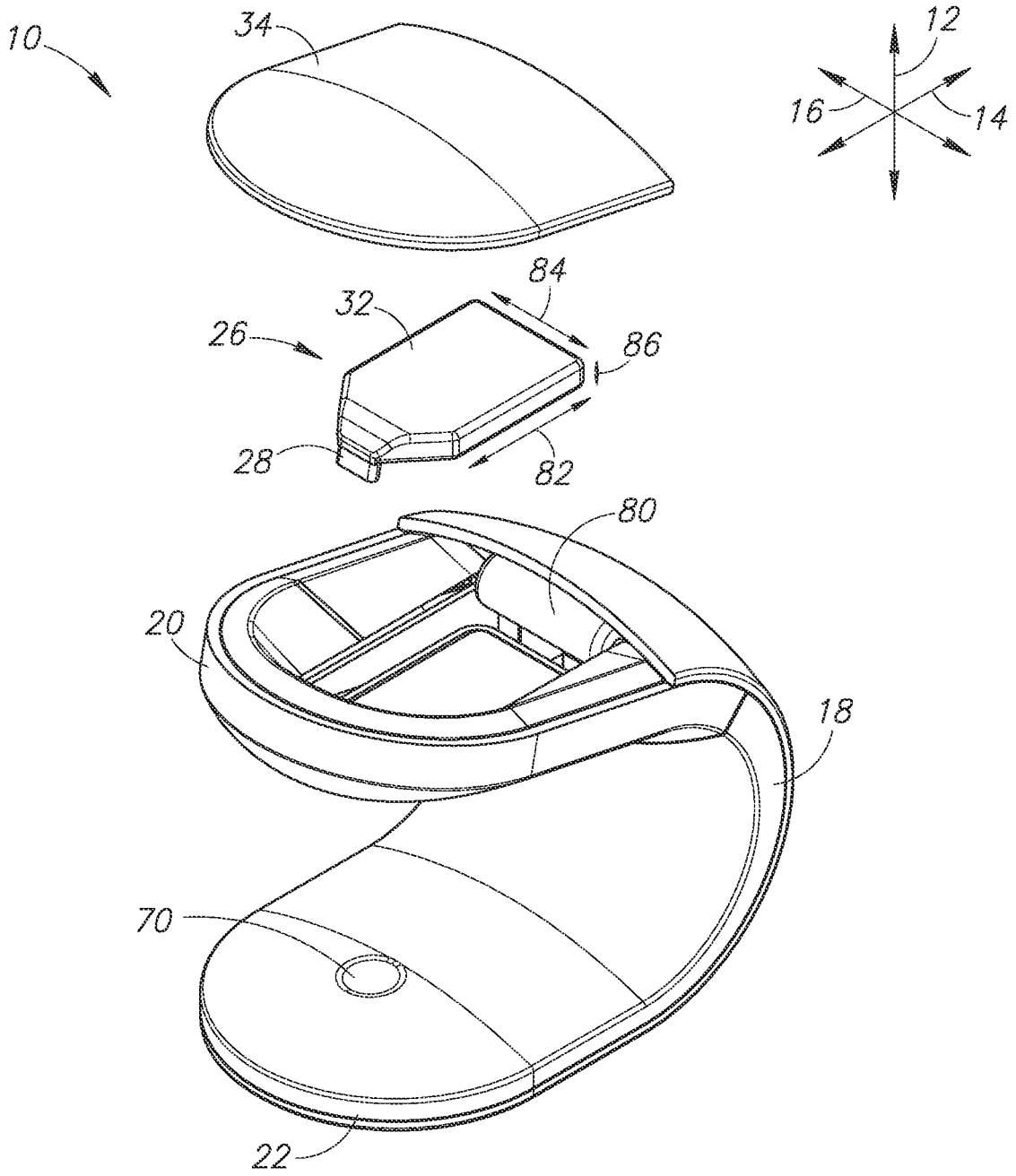
FIG. 5 is an isometric view of a second embodiment of a dispenser incorporating a rolling element in accordance with an embodiment of the invention.

Referring to FIG. 5, in some embodiments, the pressing member 36 may be embodied as a roller 80 that squeezes fluid from the reservoir 26 as it is urged across the reservoir. To facilitate this operation, the body 32 may be flat such that the length 82 and width 84 thereof are substantially greater than a thickness 86 thereof. The width 84 dimension may be parallel to an axis of rotation of the roller 80 when placed within the cavity 24 and the length 82 may be parallel to a direction of travel of the roller 80 in response to actuation thereof. The thickness 86 dimension may be perpendicular to both the length and width 82, 84 dimensions. The neck 28 may be located at or near an end of the body 32 along the length dimension 82 thereof. In particular, to enable insertion of the reservoir 26, the roller 80 may be positioned at a starting position shown in FIG. 5. The neck 28 may be located at an end of the body 32 opposite the end closest the roller 80 when in the illustrated starting position.

Figure 6:
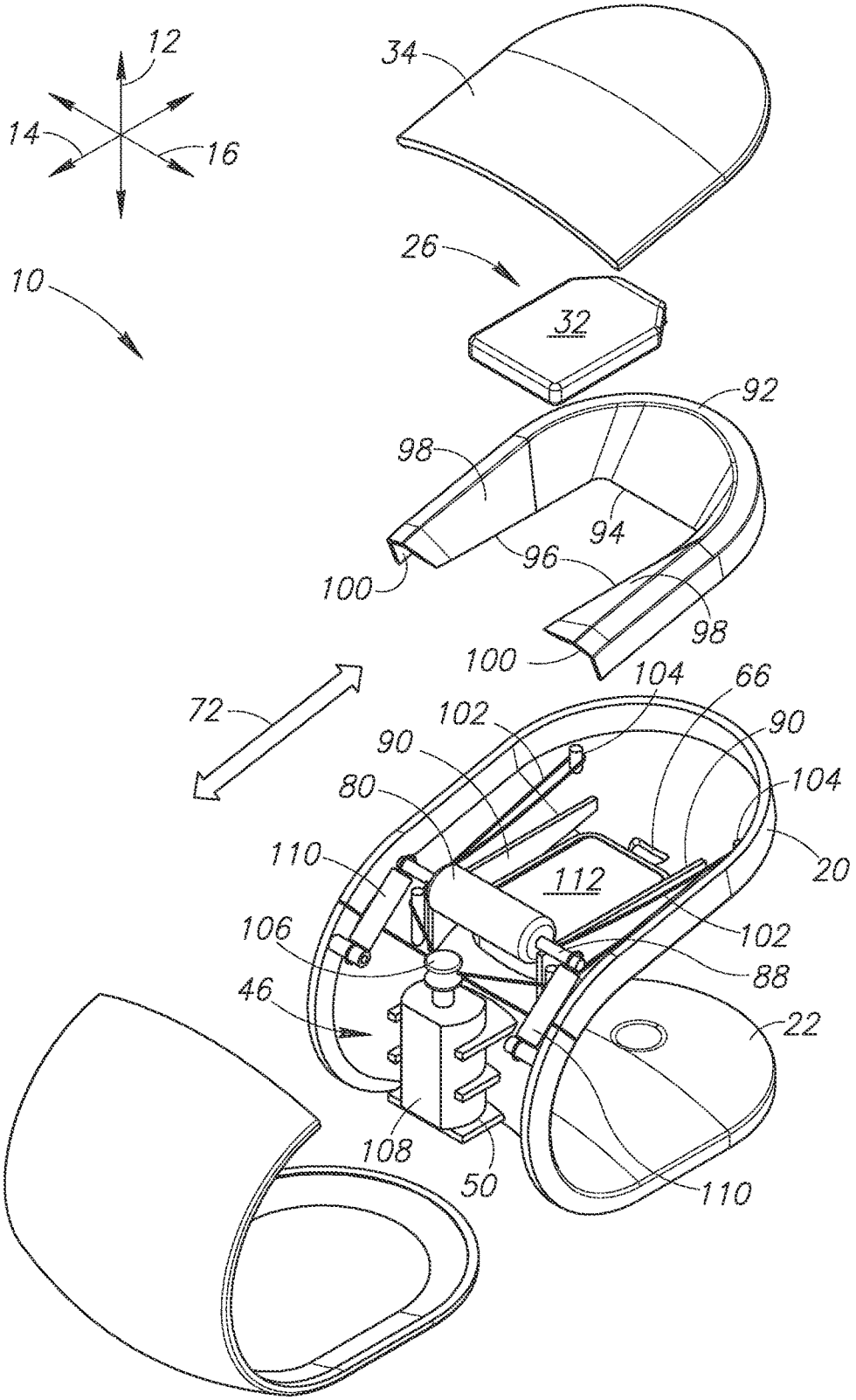
FIG. 6 is a partially exploded view of the dispenser of FIG. 5.
Figure 7:
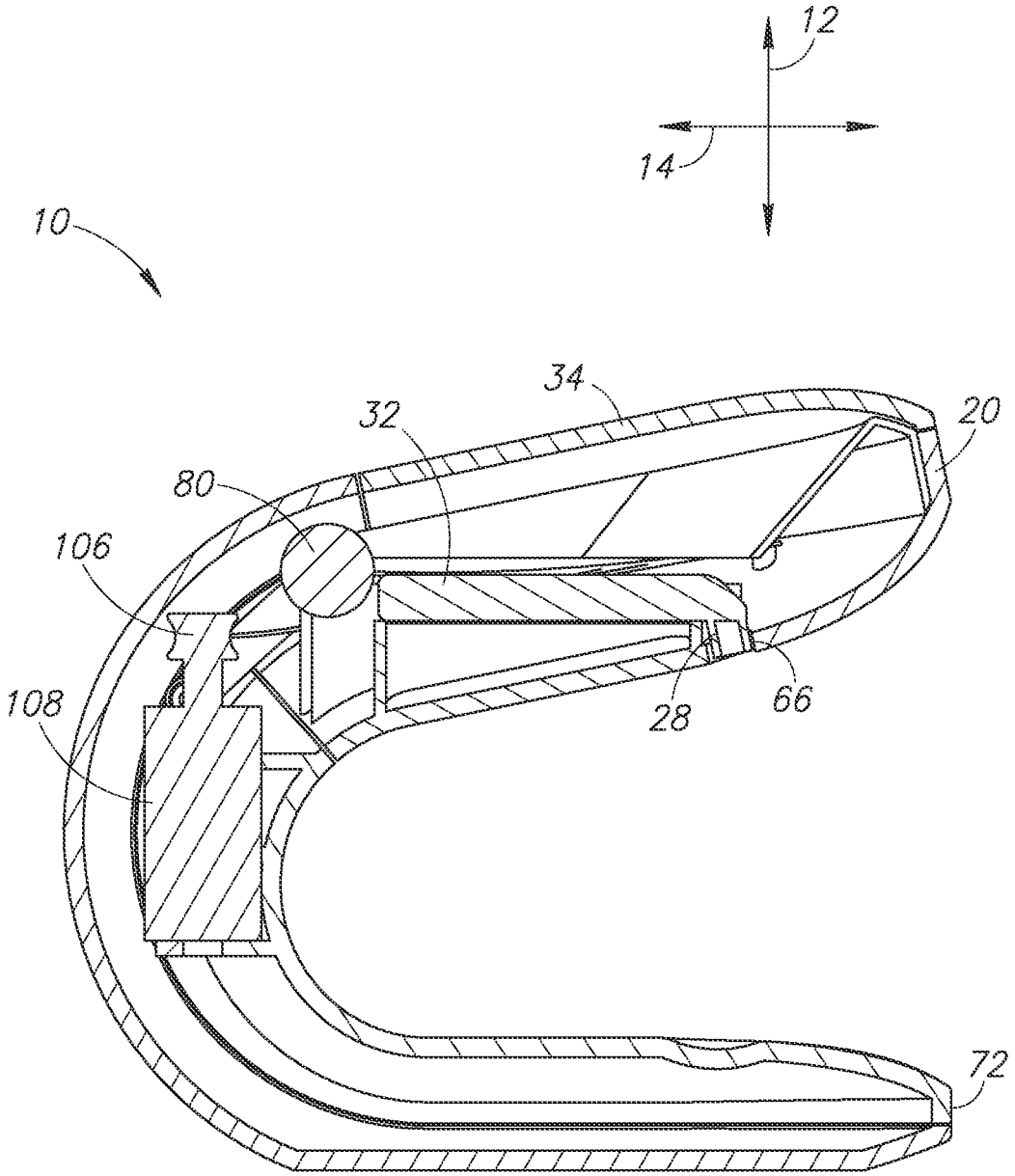
FIG. 7 is a side cross-sectional view of the dispenser of FIG. 5.

Referring to FIGS. 6 and 7, the roller 80 may rotate about one or more axles 88 having ends that protrude out of the roller 80. The axles may rest on ridges 90 that define the actuation direction 72 for the roller 80 and have upper edges parallel to the actuation direction 72. The axles 88 may further be retained on the ridges 90 by means of a U-shaped cover 92. The cover 92 may include a cutout portion 94 having parallel edges 96 between which the roller 80 is permitted to travel. The edges 96 or other portion of the cover 92 may be positioned opposite the ridges 90 in order to provide a slot within which the axles 88 may slide. The cover 92 may have faces 98 that slope upward with distance from the cutout 94 in order to guide the reservoir 26 into the cavity 24. The cover 92 may define channels 100 on either side, or a U-shaped channel extending on both sides, of the cut out portion 94.

In some embodiments, the channels 100 may provide a space for accommodating lines 102 for pulling the axle along the slot between the edges 96 and the ridges 90. In the illustrated embodiment, the lines 102 secure to ends of the axle 88, extend around posts 104, and each couple to a common pulley 106 or spool that is driven by an actuator 46 including a rotational actuator 108. In response to rotation of the rotational actuator 108, the lines are wound onto the pulley 106 thereby drawing the roller 80 toward the posts 104 and the opening 66 through which the neck 28 of the reservoir 26 passes. To return the roller 80 to the starting position, biasing members, such as springs 110 may be coupled to the housing 18 and to the axle 88 on either side of the roller 80. Upon removal of force exerted by the rotational actuator 108, the springs 110 may urge the roller back to the starting position. Alternatively, the springs may bias the roller toward a forward position of compression of the reservoir. In such an alternate embodiment, the lines 102 and actuator 108 serve to allow the roller to advance under the pull of the spring or springs and to pull the roller back against the spring pressure to a non-compressing, starting position.

The rotational actuator may maintain its state, e.g. lock when not changing position, such that the roller 80 may be stepped between various positions between the starting position and a final position nearest the opening 66. As is apparent in FIG. 6, a support surface 112 may support the body 32 of the reservoir 26 such that the body 32 is pinched between the roller 80 and the support surface 112 during movement of the roller.

The embodiment of FIGS. 5 to 7 may likewise include a controller 62, proximity sensor 52, and lights 56 configured similar to those shown in FIGS. 1 to 4. As for other embodiments disclosed herein, the controller 62 may be configured to advance the roller 80 between discrete positions in response to detecting proximity using the proximity sensor 52. Likewise, the controller 62 may be configured to return, or allow the return, of the roller 80 to the start position upon reaching the end position. The embodiments of FIGS. 5 to 7 may likewise include a heating element 74 as for the embodiments of FIGS. 1 to 4 located at a location within the upper portion 20, such as interfacing with the support surface 112 or otherwise positioned to heat air within the upper portion 20.

Figure 8:
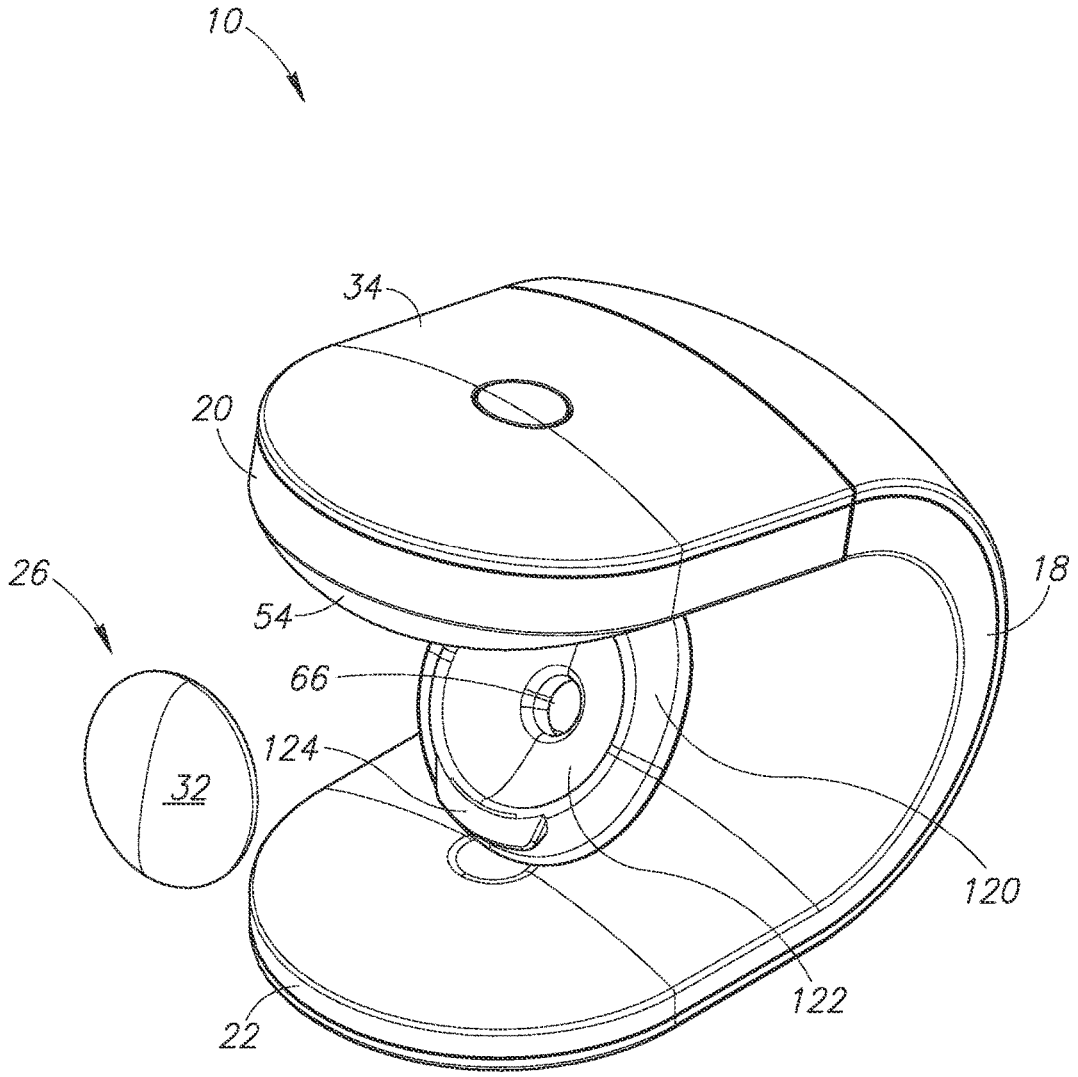
FIG. 8 is an isometric view of a third embodiment of a dispenser incorporating a plunger in accordance with an embodiment of the invention.

Referring to FIG. 8, in some embodiments, a reservoir cover 120 may secure to the lower surface 54 by a hinge or be completely removable and secure by a snap fit or some other means. The opening 66 for receiving the neck 28 of the reservoir 26 may be defined in the reservoir cover 120. Accordingly, in use, the neck 28 (see FIGS. 9-11) may be placed in the opening 66 having the body 32 of the reservoir 26 seated within a seat 122, such as a concave or other surface, and the reservoir cover 120 may then be secured to the lower surface 54.

In the illustrated embodiment, a distal end, e.g. opposite any hingedly secured end, of the cover 120 may include a ridge 124 or lip 124 for engaging a detent mechanism. However, any retention mechanism or detent mechanism may be used to retain the cover 120 in a selectively releasable manner.

Figure 9:
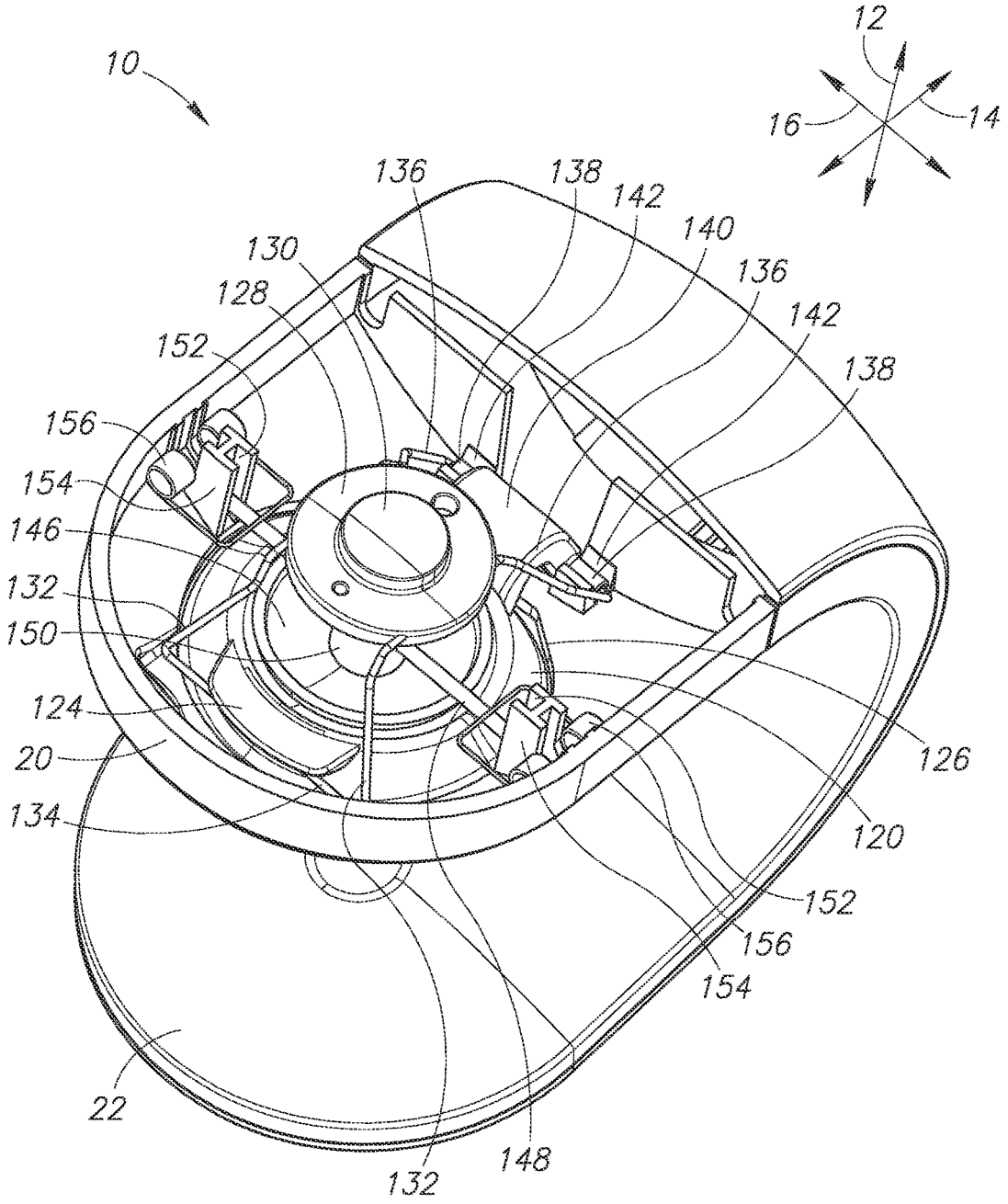
FIG. 9 is an isometric view showing a plunger mechanism of the dispenser of FIG. 8 in accordance with an embodiment of the invention.
Figure 10:
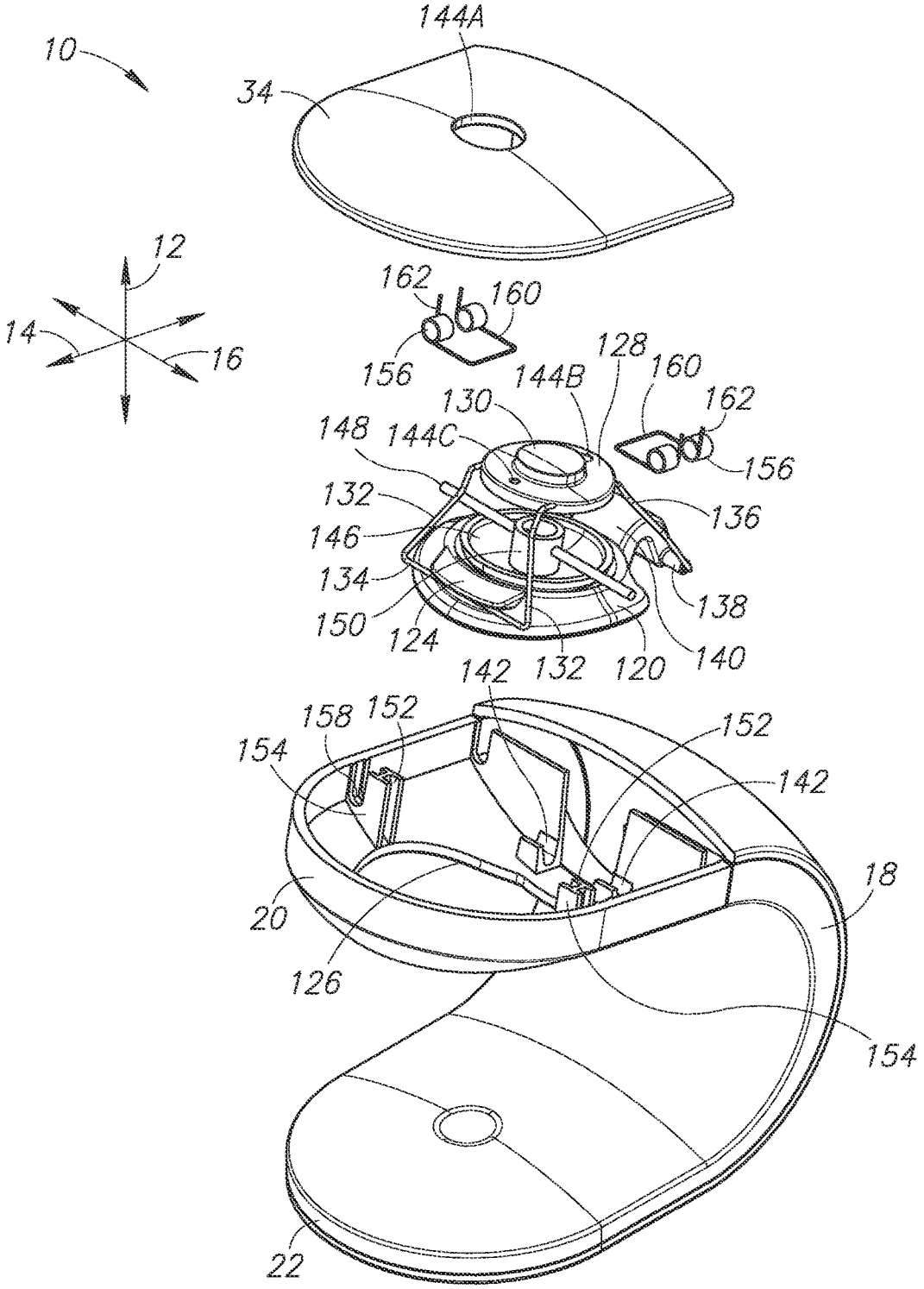
FIG. 10 is a partially exploded view of the dispenser of FIG. 8.
Figure 11:
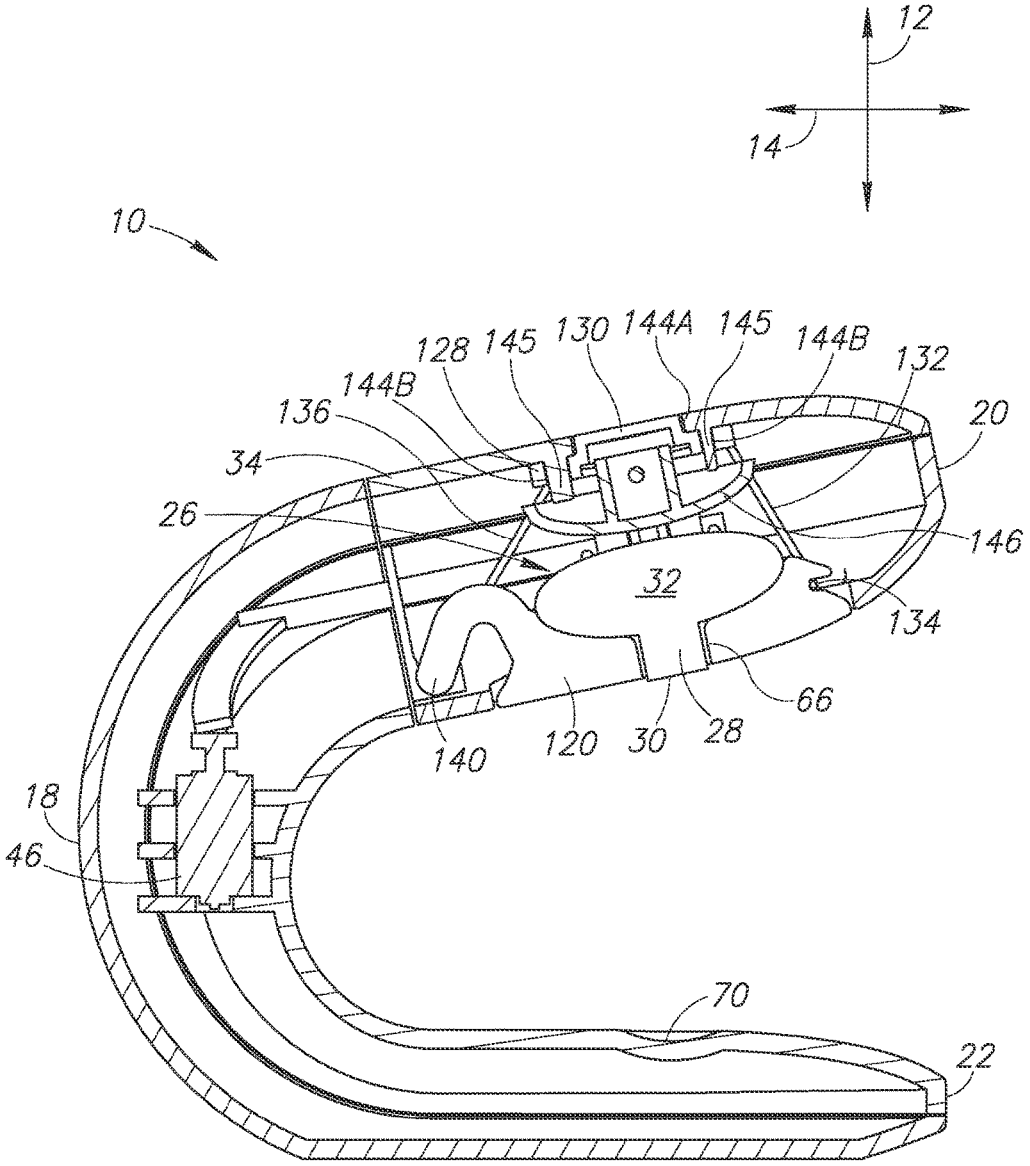
FIG. 11 is a side cross-sectional view of the dispenser of FIG. 8.

Referring to FIGS. 9 to 11, in some embodiments, the reservoir cover 120 may be hingedly secured and releasably secured within an opening 126 covered thereby using the illustrated mechanism. A hub 128 including a registration boss 130 on an upper surface thereof may have front spring arms 132 extending forwardly therefrom in the longitudinal direction 14. The front spring arms 132 may also spread laterally with distance from the hub 128. The spring arms 132 may also be bent downwardly from the hub 128 and secure to a cross bar 134 spanning the distal ends of the front spring arms 132. As shown, the cross bar 134 spans a portion of the opening 126 and engages the ridge 124 in order to retain the cover 120 within the opening 126. The spring arms 132 and cross bar 134 may be made of a resilient material, e.g. spring steel, that is capable of deforming to enable the ridge to pass over the cross bar 134. As noted above, the front spring arms 132 may be bent downwardly from the hub 128 such that a vertical gap is present between the bottom of the hub 128 and the opening 128 and the upper surface of the cover 120 positioned in the opening 126.

Rear spring arms 136 may secure to the hub 128 and project rearwardly therefrom in the longitudinal direction 14. The rear spring arms 136 may also flair outwardly from one another in lateral direction 16 and be bent downwardly from the hub 128 in the vertical direction 12. The rear spring arms 136 may pivotally secure to axle portions 138 protruding in the lateral direction 16 outwardly from the cover 120. The axle portions 138 may be cylindrical with axes extending in the lateral direction 16. The rear spring arms 136 may include bent end portions insertable within the axle portions 138. The rear spring arms 136 may be retained in engagement with the axle portions 138 due to biasing force of the rear spring arms 136. In some embodiments, the front spring arms 132, rear spring arms 134, and cross bar 134 may be part of a single metal rod or wire bent to the illustrated shape.

The axle portions 138 may be secured to the cover 120 by means of an arm 140 that extends from outside the upper portion 20 to within the upper portion 20. In the illustrated embodiment, the arm 140 is arched such that a concave lower surface thereof spans the edge of the opening 126.

The axle portions 138 may be positioned within seats 142 positioned on either side of the arm 140. As apparent in FIGS. 9 and 10, the seats 142 are open such that insertion and removal of the axle portions 138 from the seats 142. The lid 34 engages the hub 128 and urges the rear spring arms 136 downwardly and accordingly the axle portions 138 into the seats 142. In the illustrated embodiment (see FIG. 10), the lid 34 includes a registration hole 144A receiving the boss 130 formed on the hub 128 in order to maintain the hub 138 in an appropriate location within the cavity 24. In the illustrated embodiment, the registration hole 144A extends completely through the lid 124. In some embodiments, a user may press on the registration boss 130 through the hole 144A in order to depress the hub 128 and urge the cross bar 134 out of engagement with the ridge 124 and allow the reservoir cover 120 to fall out of the opening 126. In some embodiments, the hub 128 may define one or more registration holes 144A, 144B that receive one or more posts 145 (see FIG. 11) secured to an inner surface of the lid 34 or other covering of the upper portion 20.

Pressing of fluid from a reservoir 26 positioned within the cavity 24 may be accomplished by a plunger 146 actuated in substantially the vertical direction 12. In particular, the plunger 146 may move substantially vertically within a gap between the hub 128 and the seat 122 of the cover 120 (see FIGS. 12A and 12B). For example, the plunger may move substantially parallel (e.g. within +/−5 degrees of parallel) to a central axis of the opening 126. In some embodiments, the plunger 146 may be actuated by means of a cross bar 148 that spans the plunger 146 in the lateral direction 16 and may extend laterally outward beyond the plunger 146. In the illustrated embodiment, the cross bar 148 passes through a raised post 150 or tube formed on an upper surface of the plunger 146 (see FIG. 14). The ends of the cross bar 148 may slide within vertical grooves 152 defined in the upper portion 20, one on either side of the opening 126. As is apparent in FIGS. 9-11, the upper portion 20 is at a slight angle, e.g. 2 to 10 degrees, from horizontal. The grooves 152 may likewise be at a similar angle from vertical. The grooves 152 may be understood as parallel to a central axis of the opening 126 or to a direction of travel of the plunger 146. For example, the grooves 152 may be formed in posts 154 positioned on either side of the opening 126. In some embodiments, one or more springs 156 may engage the cross bar 148, or some portion of the plunger 146 or other structure secured thereto (see FIGS. 9 and 10). The springs 156 may bias the plunger toward the opening 126. The springs 156 may include first arms 160 and second arms 162.

Figure 12A:
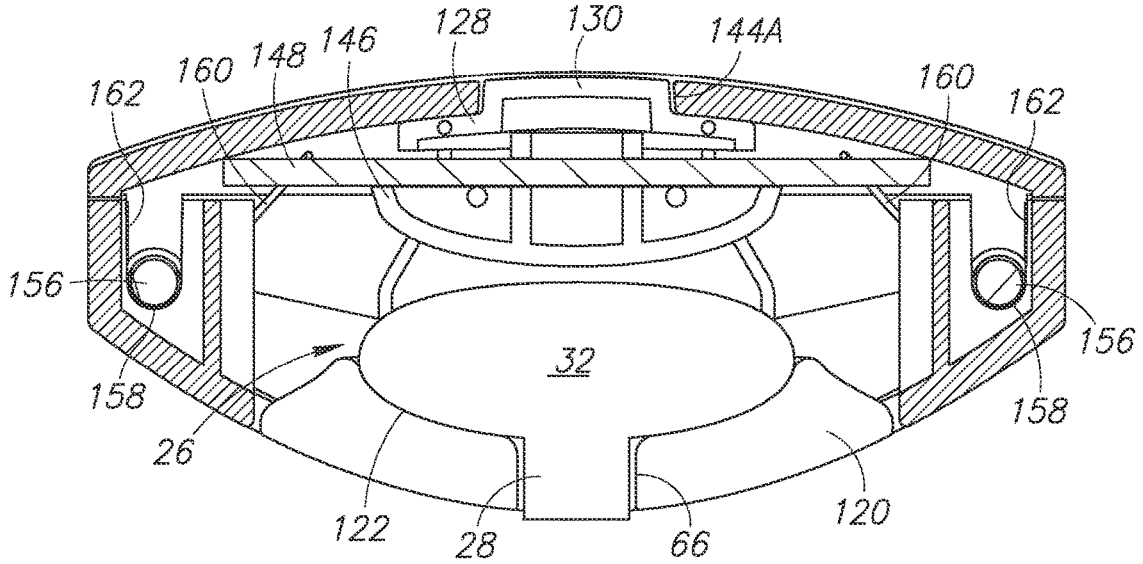
FIGS. 12A and 12B are front cross-sectional views of the dispenser of FIG. 8.
Figure 12B:
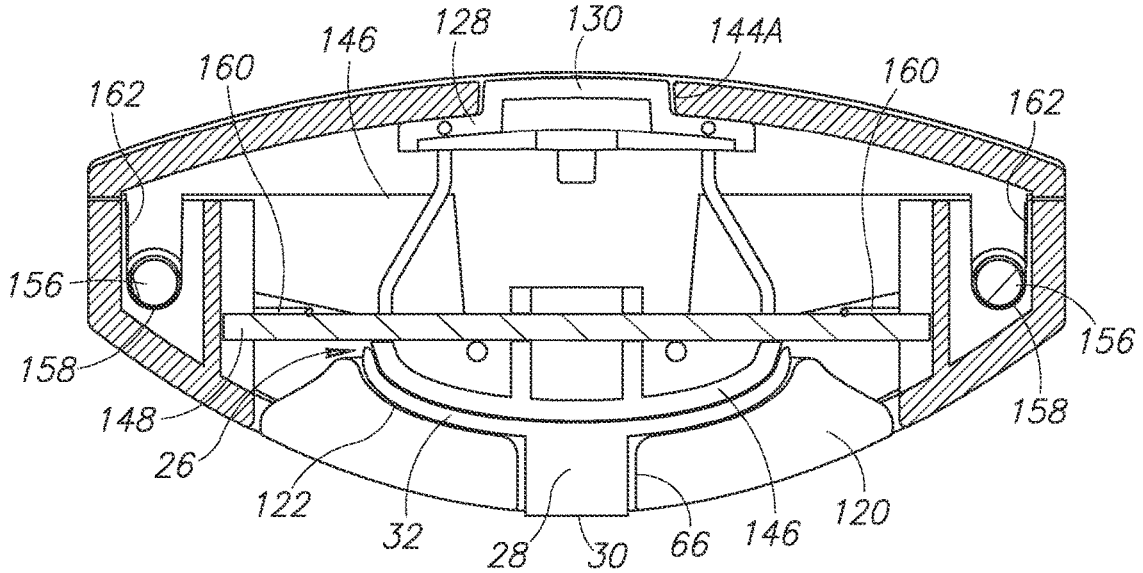

As shown in FIGS. 8 and 12A, when inserting a reservoir 26 within the cavity 24, the user may seat the reservoir 26 on the cover 120 and then urge the cover 120 upward thereby urging the reservoir 26 against the plunger 146. The configuration of FIG. 12A may be a starting position for the plunger 146. As shown in FIG. 12B, upon compression of the plunger 146 toward the cover 120, the body 32 of the reservoir 26 is compressed thereby forcing fluid from the opening 30 until the plunger 146 reaches the end position shown in FIG. 12B. The plunger 146 may be moved between a plurality of discrete positions between the illustrated start and end positions to release discrete amounts of fluid from the reservoir 126 as for other embodiments disclosed herein.

In the illustrated embodiment, the springs 156 may seat within seats 158 positioned laterally outward from the posts 150, however other positions may advantageously be used. As apparent in FIGS. 12A and 12B, the first arms 160 of the springs 156 press against the cross bar 134. The second arm 162 of each spring 156 may engage a portion of the upper portion 20 to counter torque on the arm 160.

Figure 13:
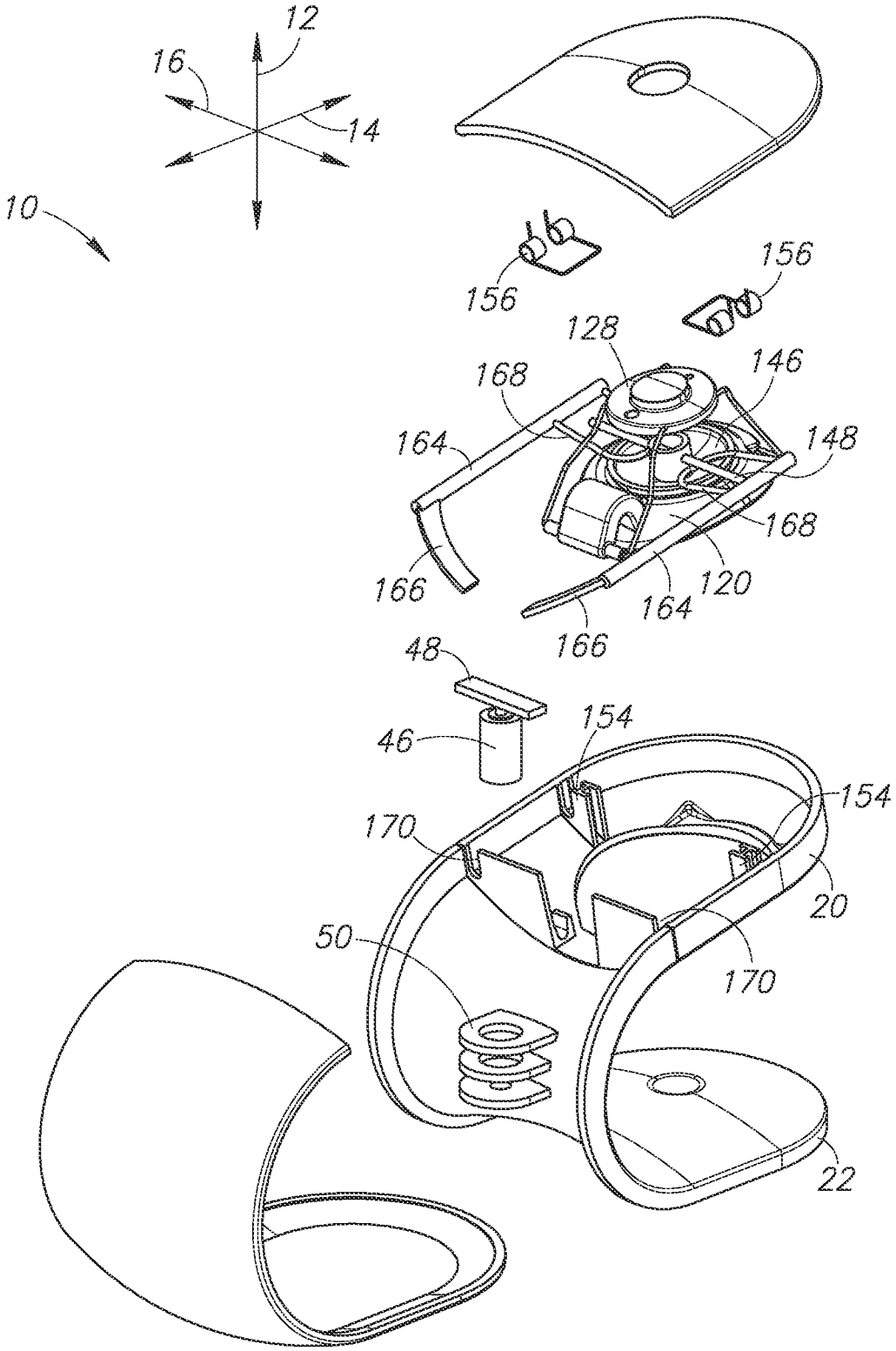
FIG. 13 is another partially exploded view of the dispenser of FIG. 8.
Figure 14:
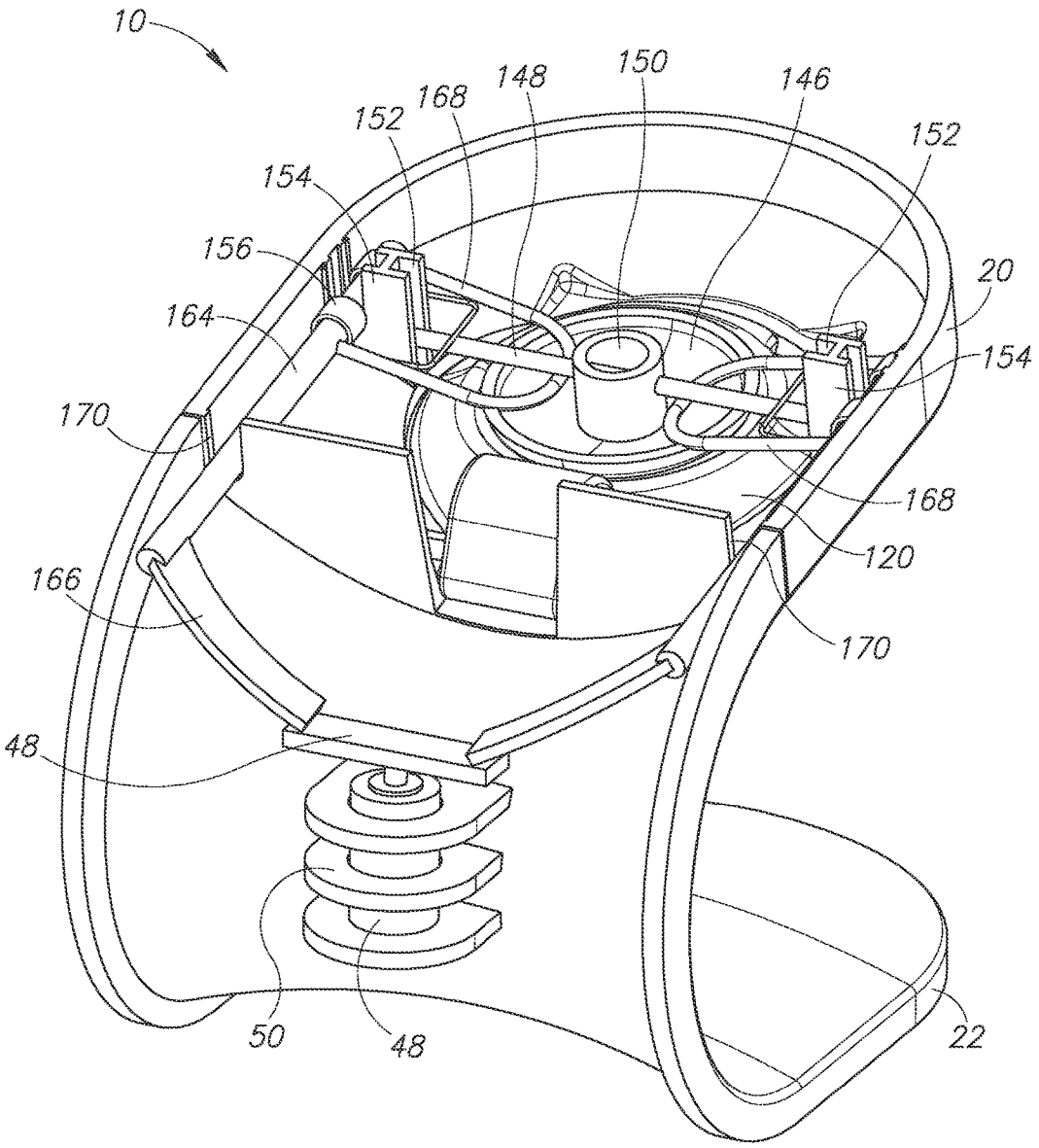
FIG. 14 is an isometric view showing an actuating assembly of the dispenser of FIG. 8 in accordance with an embodiment of the invention.

FIGS. 13 and 14 illustrate an example of an actuation mechanism that may be used to drive the plunger 146. The springs 156 may be considered part of the actuation mechanism. The actuation mechanism may include rods 164 extending along the upper portion such as in a generally longitudinal direction 14 that slopes upward similarly to the upward angle of the upper portion 20. The rods 164 may include first arms 166 secured to first end portions thereof that engage the linear actuator 46, such as by means of the spreader 48 driven up and down by the linear actuator 46. The rods 164 may include second arms 168 secured at second end portions opposite the first end portions. The rods 164 may seat within slots 170 defined by the upper portion 20.

The second arms 168 extend over the plunger 146 such that in response to rising of the arms 166, the arms 168 are also raised. In the illustrated embodiment, the arms 168 are loops that extent around the posts 154 and between the cross bar 134 and the plunger 146. As is apparent, the actuator 46 may only be able to force the arms 166 up. Accordingly, the arms 168 may be operable to counter the force of the biasing springs 156 to enable insertion of a reservoir 26. To dispense fluid, the actuator 46 may lower the spreader 50 to a different position thereby allowing the biasing force of the springs 156 to force fluid from the reservoir 26. In some embodiments, the actuator 46 may be coupled to the arms 166 such that the actuator 46 is able to force both raising and lowering of the arms 166, 168. In still other embodiments, springs 156 may urge the plunger 146 up and the actuator 46 is operable to urge the plunger 146 downward toward the cover 120. As shown in FIG. 14, in some embodiments, the rods 164 may pass through coils of the springs 156.

The embodiment of FIGS. 9 to 14 may likewise include a controller 62, proximity sensor 52, and lights 56 configured similar to the embodiment of FIGS. 1 to 4. As for other embodiments disclosed herein, the controller 62 may be configured to advance the plunger 146 between discrete positions in response to detecting proximity using the proximity sensor 52. Likewise, the controller 62 may be configured to return, or allow the return, of the plunger 146 to the start position upon reaching the end position. The embodiment of FIGS. 9 to 14 may likewise include a heating element 74 in thermal contact with the reservoir 26, cavity 24, or air within the upper portion 20.

Figure 15:
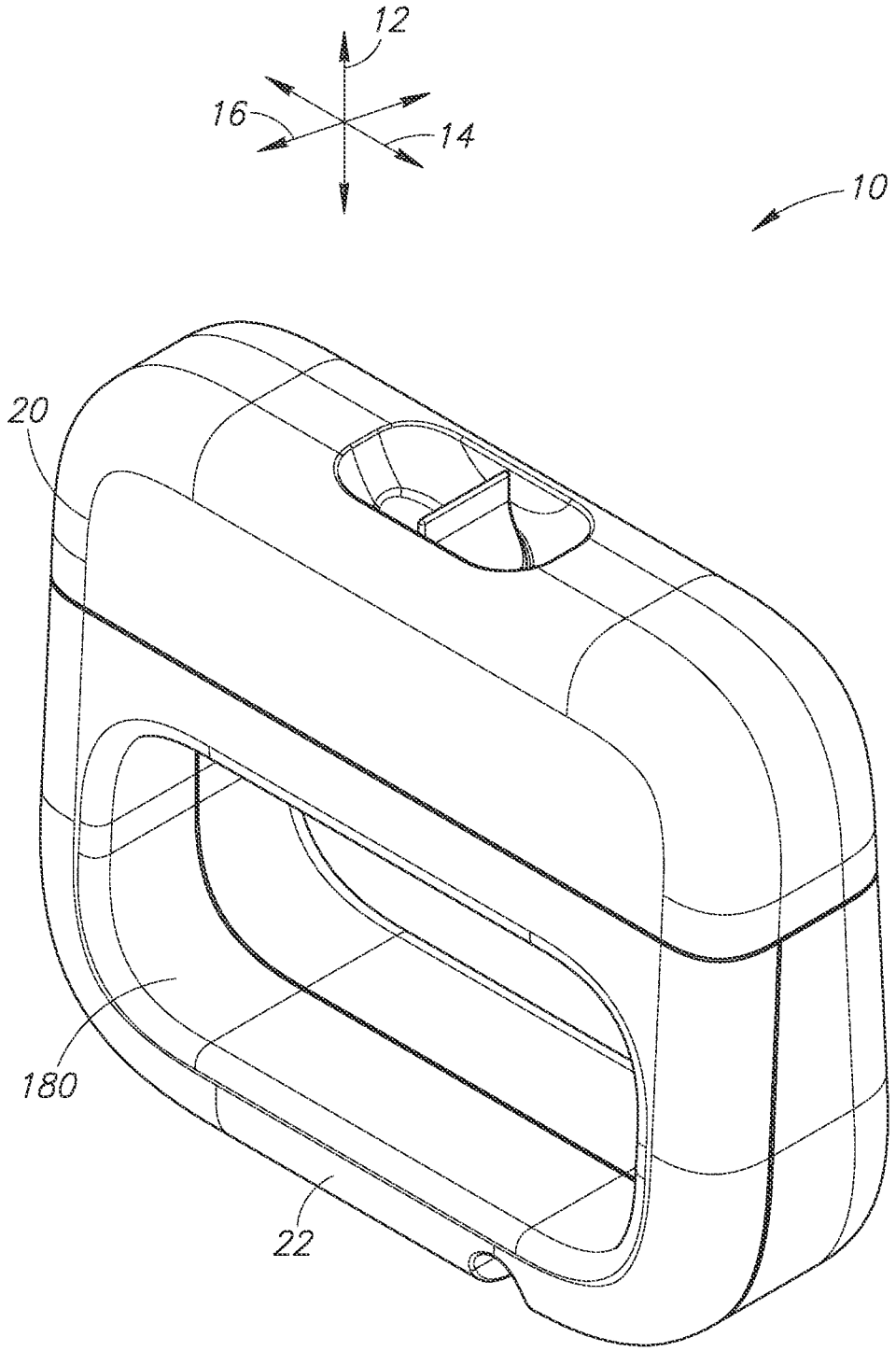
FIG. 15 is an isometric view of a fourth embodiment of a dispenser in accordance with an embodiment of the invention.
Figure 16:
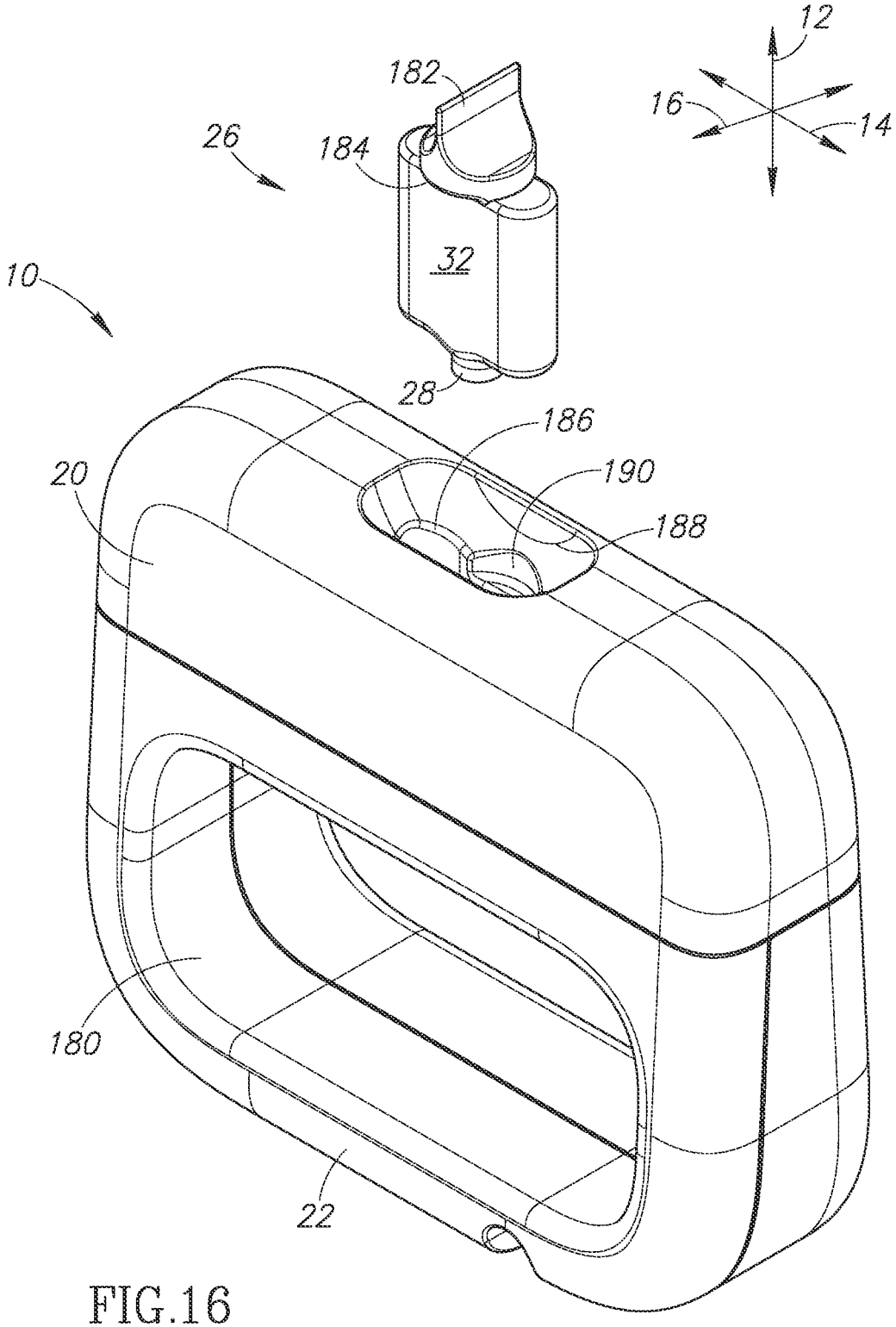
FIG. 16 is an isometric view showing the dispenser of FIG. 16 and a fluid reservoir in accordance with an embodiment of the invention.

Referring to FIGS. 15 and 16, in some embodiments, the upper portion 20 and lower portion 22 may have the illustrated configuration. In particular, rather than having being C-shaped, the upper portion 20 and lower portion 22 may join at both ends to define an opening 180 for receiving a portion of a user's hand. The embodiment of FIGS. 15 and 16 may be used with the illustrated reservoir 26. As shown, the body 32 of the reservoir 26 may have a substantially constant cross section along the height thereof. A handle 182 may be secured to the body 32 opposite the neck 28 to facilitate removal of the reservoir 26. A lip or shoulder 184 may protrude from the handle 182 and extends outwardly from the body 32.

The upper portion 20 may define an opening 186 for receiving the reservoir 26 and include a sloped surface 188 surrounding the opening 186 to guide the reservoir 26 into the opening 186. A seat 190 shaped to engage the shoulder 184 may also be positioned adjacent the opening 186.

Figure 17A:
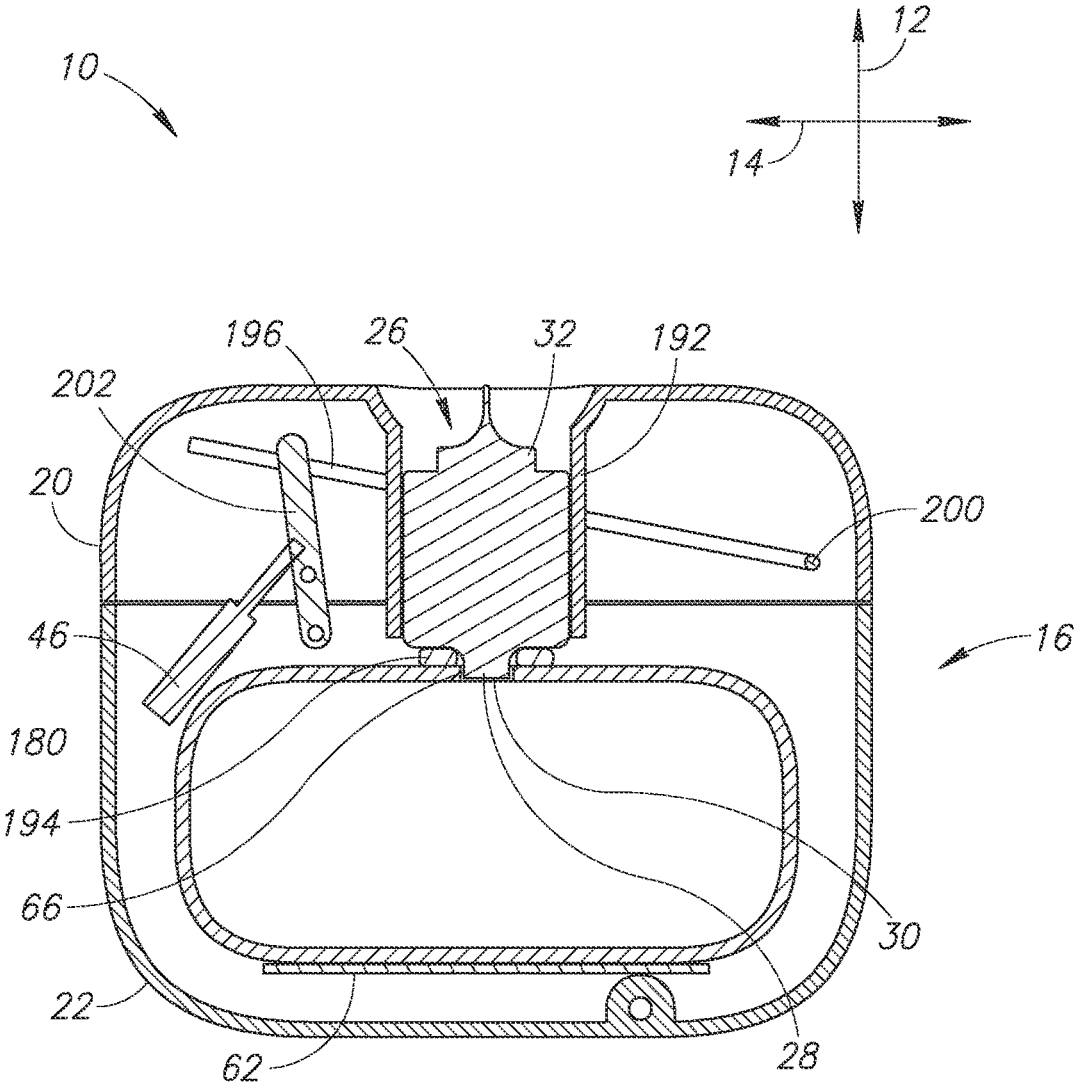
FIGS. 17A to 17C are cross-sectional views of the dispenser of FIG. 16.
Figure 17B:
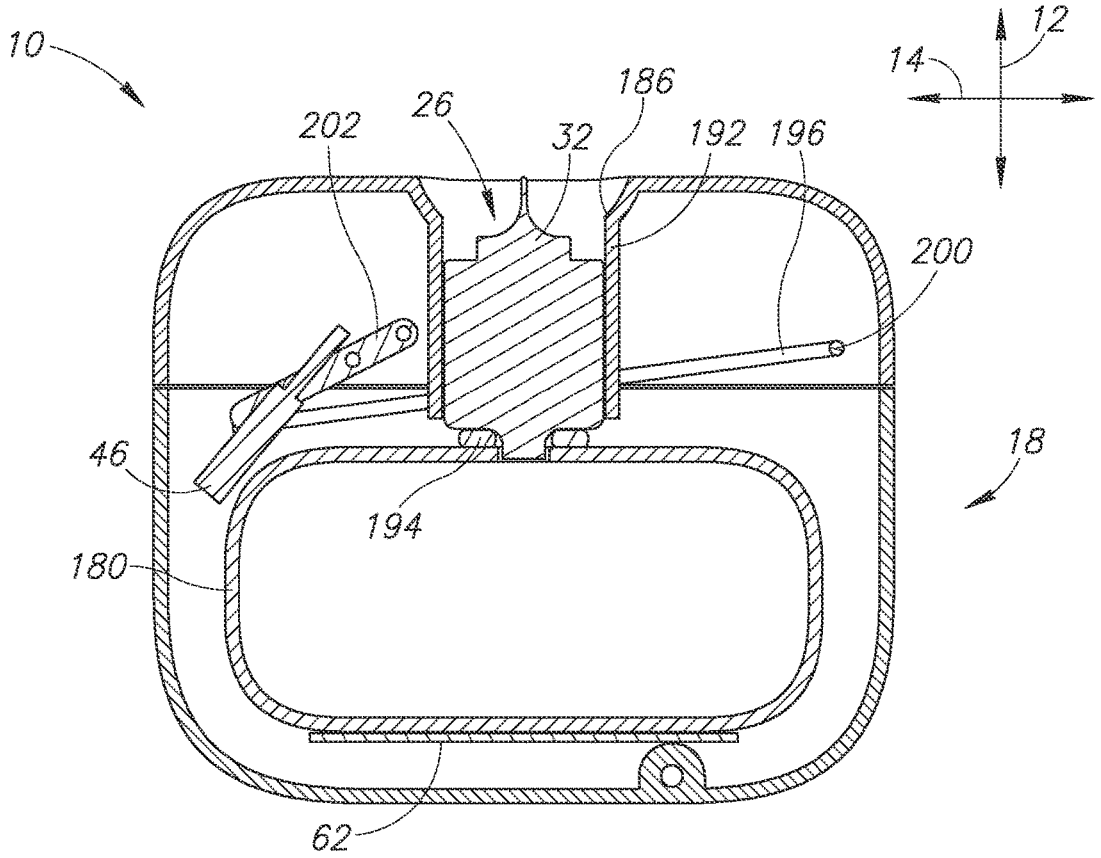
Figure 17C:
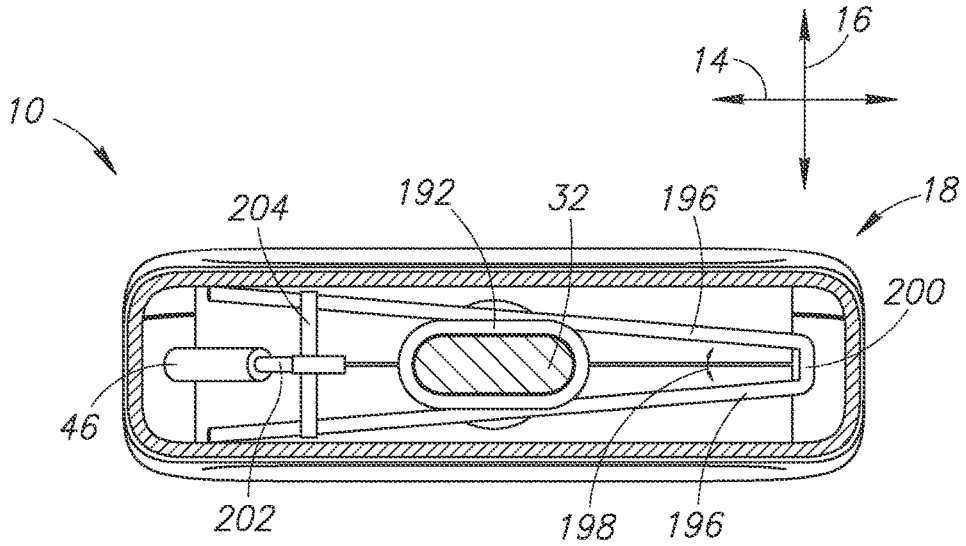

Referring to FIGS. 17A to 17C, in some embodiments the opening 186 may be defined by a flexible sleeve 192 secured to the upper portion 20. The sleeve may be open at both ends such that the neck 28 of the receiver 26 may pass therethrough and insert within the opening 66. In some embodiments, a washer 194 may be positioned above the opening 66 and the neck 28 may insert therethrough.

In the illustrated embodiment, fluid is forced from the reservoir 26 by arms 196 positioned on either side of the flexible sleeve 192. The sleeves may define an angle 198 between them. The sleeves may be pivotally secured at a pivot 200 on one side of the sleeve 192 to the housing 18 and pass on to an opposite side of the sleeve 192 having the sleeve 192 positioned therebetween. The arms 196 may be part of a single metal rod bent to the illustrated shape including a straight portion defining the pivot 200. Opposite the pivot 200, a link 202 may pivotally mount within the housing 18 and to the arms 196, such as by means of a cross bar 204 secured to both bars arms 196. The actuator 46 may pivotally secure to the link 202, such as at a point between the points of securement of the arms 196 to the link 202 and a point of securement of the link 202 to the housing 18. However, the actuator 46 may also be coupled to the link 202 at another point along the link 202. The actuator 46 may be pivotally mounted to the housing 18 as well such that the actuator 46 pivots during actuation thereof.

As shown in FIGS. 17A and 17B, the actuator 46 may shorten thereby drawing the arms 196 down over the flexible sleeve 192 and forcing fluid out of the opening 30. As for other embodiments, the actuator 46 may move the arms 196 between discrete positions from a start position (FIG. 17A) to an end position (FIG. 17B). The controller 62 may cause the actuator 46 to return the arms 196 to the start position upon the arms 196 reaching the end position. In the illustrated embodiment, the controller 62 is positioned below the opening 180.

The embodiment of FIGS. 15 to 18C may likewise include a controller 62, proximity sensor 52, and lights 56 configured similar to the embodiment of FIGS. 1 to 4. As for other embodiments disclosed herein, the controller 62 may be configured to advance the arms 196 between discrete positions in response to detecting proximity using the proximity sensor 52. Likewise, the controller 62 may be configured to return, or allow the return, of the arms 196 to the start position upon reaching the end position. The embodiment of FIGS. 15 to 18C may likewise include a heating element 74 in thermal contact with the reservoir 26, cavity 24, or air within the housing 18.

While the preferred embodiments of the invention have been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A dispenser comprising:

a reservoir having a fluid reservoir body, a valve, and a fluid delivery opening;

a housing defining a longitudinal direction, a horizontal direction perpendicular to the longitudinal, and a vertical direction perpendicular to the longitudinal direction and the horizontal directions, the housing includinga base configured to provide stability for the dispenser relative to a support surface that is parallel to the longitudinal direction and the horizontal direction; and a top portion positioned above the base, the top portion and the base defining a gap, the top portion defining a cavity having a stop face, a lower wall for supporting the reservoir, an opening extending through the lower wall directly above the gap, and an upper wall opposite the lower wall, the upper wall defining an insertion aperture sized to receive the reservoir;

a pressing member located within the cavity, the pressing member having a surface for engaging a first side of the reservoir positioned within the cavity and slidable between a start position and an end position along an actuator direction that is within 20 degrees from parallel to the longitudinal direction, the end position being closer to the stop face than the start position, the stop face being positioned to engage a second side of the reservoir opposite the first side, the stop face being between 2 degrees and 10 degrees from perpendicular to the actuation direction, the opening being positioned between the stop face and the pressing member along the actuator direction and being closer to the stop face than the pressing member along the actuator direction when the pressing member is in the start position; and an actuator coupled to the pressing member, the actuator selectively moving the pressing member between discrete positions between the start and end positions.

2. The dispenser of claim 1, wherein the valve is a pressure actuated opening at a distal end thereof, the neck extending into the opening in the top portion of the housing.

3. The dispenser of claim 2, wherein no portion of the dispenser other than the base is positioned in a flow path vertically beneath the pressure actuated opening.

4. The dispenser of claim 1, further comprising a controller mounted within the housing and operably coupled to the actuator, the controller configured to selectively activate the actuator, the controller activating the actuator to advance the actuator toward the fluid delivery opening upon first being activated, and advancing the pressing member more a second time of activation, the pressing member moving further toward the fluid delivery opening from the previous position.

5. The dispenser of claim 4, further comprising:

a proximity sensor mounted in the housing and configured to detect movement within the gap;

wherein the proximity sensor is operably coupled to the controller, the controller configured to activate the actuator in response to an output of the proximity sensor, a second activation moving the pressing member further toward the fluid delivery opening from the position of the first activation.

6. The dispenser of claim 5, wherein the proximity sensor is mounted within the top portion and the controller is mounted within the base.

7. The dispenser of claim 6, further comprising a light emitting device mounted within the top portion, the top portion including a downward facing translucent panel positioned below the light emitting device.

8. The dispenser of claim 5, wherein the controller is configured to activate the actuator to move between a plurality of discrete positions including the start position and the end position in response to detecting of movement in the gap by the proximity sensor.

9. The dispenser of claim 8, wherein the controller is configured to activate the actuator to move to the start position in response to detecting positioning of the actuator in the end position.

10. The dispenser of claim 1, further including a temperature-control element having a heating element and a temperature sensor, wherein the heating element is in thermal contact with the fluid in the fluid reservoir.

11. The dispenser of claim 1, wherein the reservoir is positioned between the stop face and the pressing member, the reservoir having a neck positioned between the stop face and the pressing member and protruding into the opening.

12. The dispenser of claim 11, wherein:

the reservoir defines a lateral surface engaging the lower wall and a top surface engaging the stop face, the neck protruding outwardly from the lateral surface and into the opening.

13. The dispenser of claim 12, further comprising a lid removably positioned within the insertion aperture.

14. The dispenser of claim 1, wherein the pressing member defines a recess opposite the surface, the actuator having a portion inserting within the recess.

15. The dispenser of claim 1, wherein a normal of the stop face is parallel to the actuator direction.

16. A dispenser comprising:

a housing defining a longitudinal direction, a horizontal direction perpendicular to the longitudinal, and a vertical direction perpendicular to the longitudinal direction and the horizontal directions, the housing includinga base configured to stably rest on a support surface that is parallel to the longitudinal direction and the horizontal direction; and a top portion positioned above the base such that a gap between the base and top portion is present, the top portion defining a cavity having a stop face, a lower wall for supporting a fluid reservoir, an opening extending through the lower wall directly above the gap, and an upper wall opposite the lower wall, the upper wall defining an insertion aperture sized to receive the fluid reservoir, the cavity is configured to receive a body of the fluid reservoir including a neck, the opening configured to receive the neck of the fluid reservoir when the body thereof is positioned within the cavity;

a pressing member positioned within the cavity and configured to contact a second surface of the fluid reservoir and a first surface of the fluid reservoir substantially opposes the second surface and contacts the stop face of the top portion, the pressing member being slidable within the cavity along an actuator direction between a start position and an end position, the actuator direction being within 20 degrees of parallel to the longitudinal direction, the opening being positioned between the pressing member and the stop face along the actuator direction and being closer to the stop face than to the pressing member along the actuator direction when the pressing member is in the start position;

an actuator coupled to the pressing member and the actuator configured to urge the pressing member progressively toward the opening to compress the fluid reservoir and express fluid therefrom in multiple discrete amounts;

a proximity sensor mounted in the top portion and configured to detect movement within the gap and produce and output in response to detecting the movement; and a controller operably coupled to the actuator and proximity sensor and configured to activate the actuator in response to receiving the output from the proximity sensor.

17. The dispenser of claim 16 wherein:

the stop face of the top portion has a normal that is substantially angled with respect to the actuator direction and is offset to a first side of the opening; and the pressing member includes a pressing face extending upward from the opening and having a normal substantially parallel to the actuator direction.

18. The dispenser of claim 17, wherein the top portion defines rails extending perpendicular to the actuator direction, the pressing member being configured to slidingly receive the rails.

19. The dispenser of claim 17, wherein the body of the reservoir has a substantially constant cross section along substantially an entire extent of the body between the first and second surfaces.

* * * * *